US007344221B2

(12) United States Patent
Miyakawa et al.

(10) Patent No.: US 7,344,221 B2
(45) Date of Patent: Mar. 18, 2008

(54) HEAD MEMBER, METHOD FOR INK-REPELLENT TREATMENT AND APPARATUS FOR THE SAME

(75) Inventors: Takuya Miyakawa, Nagano-ken (JP); Yoshiyuki Isobe, Nagano-ken (JP); Takeshi Yasoshima, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 433 days.

(21) Appl. No.: 11/069,552

(22) Filed: Mar. 2, 2005

(65) Prior Publication Data

US 2005/0168528 A1 Aug. 4, 2005

Related U.S. Application Data

(62) Division of application No. 10/031,442, filed on Jan. 22, 2002, now Pat. No. 6,923,525.

(51) Int. Cl.
*B41J 2/165* (2006.01)
*B41J 2/135* (2006.01)

(52) U.S. Cl. ..... 347/29; 347/45

(58) Field of Classification Search ..... 347/29, 347/45

See application file for complete search history.

(56) References Cited

U.S. PATENT DOCUMENTS

| | | | | |
|---|---|---|---|---|
| 5,182,000 A | | 1/1993 | Antonelli et al. | |
| 5,306,671 A | * | 4/1994 | Ogawa et al. | 438/595 |
| 6,008,137 A | | 12/1999 | Lee et al. | |
| 6,109,728 A | | 8/2000 | Kakuda et al. | |
| 6,243,112 B1 | | 6/2001 | Kuhman et al. | |
| 6,511,156 B1 | | 1/2003 | Kazama et al. | |

FOREIGN PATENT DOCUMENTS

| | | |
|---|---|---|
| DE | 39 21 652 A1 | 1/1991 |
| EP | 0 816 096 A2 | 1/1998 |
| EP | 0 942 026 A2 | 9/1999 |
| JP | 60-013065 | 1/1985 |
| JP | 60 178065 | 9/1985 |
| JP | 63-81050 A | 4/1988 |
| JP | 63-199429 | 8/1988 |
| JP | 64-87359 A | 3/1989 |

(Continued)

OTHER PUBLICATIONS

European Supplemental Search Report in English.

*Primary Examiner*—An H. Do
(74) *Attorney, Agent, or Firm*—Sughrue Mion, PLLC

(57) ABSTRACT

Disclosed are a head member having an ink-repellent film high in ink repellency, a method of ink-repellent treatment for the head member and an apparatus for the same. A head member (15) including a plurality of ejection ports (14) to eject ink which includes an ink-repellent film (25) on a surface having the ejection ports (14) open thereon, the ink-repellent film made of fluorocarbon resin subjected to plasma polymerization on the surface. An ink-repellent treatment method includes the steps of: disposing the head member (15) in a chamber (31) maintained in a vacuum state; introducing gaseous linear perfluorocarbon as a material of an ink-repellent film into the chamber (31); and depositing an ink-repellent film (14) made of fluorocarbon resin obtained by subjecting the perfluorocarbon to plasma polymerization on the surface of the head member (15) to perform the ink-repellent treatment.

2 Claims, 15 Drawing Sheets

FOREIGN PATENT DOCUMENTS

| | | | |
|---|---|---|---|
| JP | 01-23077 | | 9/1989 |
| JP | 03-229886 | | 10/1991 |
| JP | 04-229277 | | 8/1992 |
| JP | 4-345883 | A | 12/1992 |
| JP | 05-029652 | | 2/1993 |
| JP | 05-243138 | | 9/1993 |
| JP | 06-171081 | | 6/1994 |
| JP | 08-264446 | | 10/1996 |
| JP | 08-337676 | | 12/1996 |
| JP | 09 136423 | | 5/1997 |
| JP | 10235266 | A * | 9/1998 |
| JP | 11-152569 | A | 6/1999 |
| JP | 2000-326514 | A | 11/2000 |
| WO | WO 96/33293 | | 10/1996 |

* cited by examiner (a)

(b)

HEAD MEMBER, METHOD FOR INK-REPELLENT TREATMENT AND APPARATUS FOR THE SAME

This is a divisional of application Ser. No. 10/031,442, filed Jan. 22, 2002 now U.S. Pat. No. 6,923,525, which is incorporated herein by reference in its entirety.

TECHNICAL FIELD

The present invention relates to a head member of an ink-jet recording head, a method of ink-repellent treatment for the head member and an apparatus for the same, more particularly to the one subjected to ink-repellent treatment by polymerization treatment using perfluorocarbon and carbon tetrafluoride as needed.

Moreover, the present invention relates to a method for removing fluorocarbon resin in micropores and an apparatus for the same, more particularly to a method for removing fluorocarbon resin in ejection ports of a head member of an ink-jet recording head and an apparatus for the same.

BACKGROUND ART

In the ink-jet recording head, a constitution is adopted, in which a nozzle plate as a head member has a large number of micro ejection ports to eject ink, the micro ejection ports being formed to be separated at a micro interval from one to another. FIG. 13 is a sectional view of the nozzle plate of the ink-jet recording head. This nozzle plate 200 is provided with ejection ports 202 to eject ink 201. As shown in FIG. 13(*a*), the ink 201 is ejected from ejection surfaces 203 of the ejection ports 202 toward a printing surface.

However, as shown in FIG. 13(*b*), attached ink 204 sometimes remains on tip surfaces (ejection surfaces) 203 of the nozzle plate 200. In such a case, when ink 205 ejected the next time contacts the remaining attached ink 204 as shown in FIG. 13(*b*), an ejection trajectory of the ink 205 is bent, being affected by surface tension, viscosity or the like of the attached ink 204. As described above, since printing cannot be performed to a specified spot when the attached ink 204 remains on the ejection surfaces 203, pretreatment is required so that the attached ink 204 will not remain on the ejection surfaces 203.

Heretofore, the ejection surfaces 203 have been subjected, for example, to eutectoid plating with fluorocarbon resin and nickel to make the ejection surfaces 203 ink-repellent, so that the ejected ink 201 would not remain on the ejection surfaces 203.

However, as shown in FIG. 14, when ink-repellent films 206 are formed, fluorocarbon resin 207 are attached onto the ejection ports 202 in some cases. Since flows of the ink into the ejection ports 202 are hindered by the fluorocarbon resin 207 when such fluorocarbon resin 207 are attached, removal of the fluorocarbon resin 207 from the ejection ports 202 has been required.

Heretofore, the fluorocarbon resin 207 have been made not to remain in the ejection ports 202 by methods shown in FIG. 15 and FIG. 16. The method shown in FIG. 15 is a method for preventing the attachment of the fluorocarbon resin 207, in which a plug member 208 such as plastic fills the ejection ports 202 before the ink-repellent films 206 are formed. The eutectoid plating is performed after filling with the plug member 208 as described above, thus the fluorocarbon resin 207 can be prevented from being attached onto the ejection ports 202 when the ink-repellent films 206 are formed. Moreover, the method shown in FIG. 16 is a method for removing the fluorocarbon resin 207 attached onto the ejection ports 202, in which the fluorocarbon resin 207 are removed by ultrasound cleaning. Specifically, the nozzle plate 200 is immersed, for example, in an organic solvent 209, and the organic solvent 209 is flown into the ejection ports 202. Then, ultrasound 211 is generated in the organic solvent 209 by an ultrasound generating source 210 disposed under the organic solvent 209. By this ultrasound 211, the fluorocarbon resin 207 attached onto the ejection ports 202 have been removed.

However, there have been problems as below in the conventional methods.

The conventional ink-repelling method by the eutectoid plating with the fluorocarbon resin and the nickel has required much time and labor as cleaning of the nozzle plate before and after the plating was required, which has been a cause of lowering productivity and increasing the labor. Moreover, in the case where the ink ejection ports have a complicated shape, spots not being subjected to the plating may exist on the ejection surfaces. When such spots not being subjected to the plating exist on the ejection surfaces 203, the attached ink remains on the spots, and the ink changes its ejection trajectory, which has been a problem. And, since the eutectoid plating includes not only the fluorocarbon resin but also the nickel, ink repellency is deteriorated by that amount. Moreover, since it takes time to form the eutectoid plating, there has been a problem in terms of working efficiency. Still further, when the ink-repelling method using the eutectoid plating is performed, there has been a problem since a cost thereof is high.

Moreover, in the above-described method for preventing the attachment of the fluorocarbon resin in the ejection ports, since the ejection ports have a port diameter of about several ten μm, which is micro, it takes time and labor to fill the ejection ports with the plug member and to remove the same from the ejection ports. Furthermore, there is a possibility that the plug member is attached onto the ejection ports.

Furthermore, also in the method for removing the fluorocarbon resin by the ultrasound cleaning, since the ejection ports are micro, cleaning using the ultrasound has been time-consuming. Moreover, when the organic solvent flown into the ejection ports contacts the formed ink-repellent films because of the solvent's surface tension, even the ink-repellent films are removed, which has been a problem.

The present invention was made in order to solve the foregoing problems, and has an object to form an ink-repellent film high in ink repellency on a head member by use of plasma polymerization.

Moreover, the present invention has an object to provide a head member having high ink repellency.

Furthermore, the present invention has an object to form an ink-repellent film on a head member at a low cost.

Still further, the present invention has an object to form an ink-repellent film high in durability on a head member.

Yet further, the present invention has an object to remove fluorocarbon resin in ejection ports as micropores without affecting peripheries thereof.

DISCLOSURE OF THE INVENTION

A first aspect of the present invention, which solves the foregoing subjects, is a head member including a plurality of ejection ports to eject ink, comprising: an ink-repellent film on a surface having the ejection ports open thereon, the ink-repellent film made of fluorocarbon resin subjected to plasma polymerization on the surface.

In the first aspect, the ink-repellent film high in ink repellency can be formed on the ejection surface of the head member.

A second aspect of the present invention according to the first aspect is the head member characterized in that the ink-repellent film is formed by plasma polymerization of linear perfluorocarbon.

In the second aspect, a hydration degree of the ink-repellent film can be restrained to be relatively low.

A third aspect of the present invention according to any one of the first and second aspects is the head member characterized in that the ink-repellent film is formed by plasma polymerization of linear perfluorocarbon mixed with carbon tetrafluoride.

In the third aspect, a relative polymerization degree of the ink-repellent film can be restrained to be relatively low.

A fourth aspect of the present invention according to any one of the first to third aspects is the head member characterized in that the relative polymerization degree of the ink-repellent film is 0.2 or lower.

In the fourth aspect, a ratio of $CF_3$ contained in the ink-repellent film is relatively low, and a polymerization degree is relatively high.

A fifth aspect of the present invention according to any one of the first to fourth aspects is the head member characterized in that the hydration degree of the ink-repellent film is 0.2 or lower.

In the fifth aspect, by restraining the hydration degree of the ink-repellent film to be relatively low, that is, by relatively decreasing a ratio of a hydroxyl group contained in the ink-repellent film, the ink repellency is improved.

A sixth aspect of the present invention according to any one of the first to fifth aspects is the head member characterized in that the ink-repellent film is provided only in the vicinity of apertures of the ejection ports.

In the sixth aspect, since the ink-repellent film is provided only in a part of the head member, the ink-repellent film can be formed in a short time.

A seventh aspect of the present invention according to any one of the first to sixth aspects is the head member characterized in that the ink-repellent film does not exist on inner surfaces of the ejection ports.

In the seventh aspect, flows of ink into the ejection ports are not hindered by the ink-repellent film, and ink ejection characteristics can be well maintained.

An eighth aspect of the present invention according to the first to seventh aspects is the head member characterized in that the head member is a nozzle plate formed by drilling the ejection ports in a flat plate.

In the eighth aspect, the nozzle plate having the ink-repellent film high in ink repellency provided thereon can be formed relatively readily.

A ninth aspect of the present invention according to any one of the first to seventh aspects is the head member characterized in that the ejection ports and at least a part of pressure generating chambers communicating with the ejection ports are formed.

In the ninth aspect, since at least a part of the ejection ports and the pressure generating chambers are integrally formed, a manufacturing process can be simplified to achieve a low cost.

A tenth aspect of the present invention according to any one of the first to ninth aspects is the head member characterized in that the head member consists of a single crystal silicon substrate.

In the tenth aspect, the ejection ports can be formed with high accuracy and high density, and the ink ejection characteristics can be improved.

An eleventh aspect of the present invention is an ink-jet recording head, comprising: the head member according to any one of the first to tenth aspects; a passage-forming substrate defining pressure generating chambers communicating with ejection ports of the head member; and pressure applying means for applying pressure to ink in the pressure generating chambers.

In the eleventh aspect, an ink-jet recording head can be realized, in which ink can be ejected well and print quality is improved.

A twelfth aspect of the present invention is an ink-jet recording apparatus comprising the ink-jet recording head according to the eleventh aspect.

In the twelfth aspect, an ink-jet recording head can be realized, in which the print quality is improved.

A thirteenth aspect of the present invention is an ink-repellent treatment method for a surface of a head member including a plurality of ejection ports to eject ink, the surface having the ejection ports open thereon, the method comprising the steps of: disposing the head member in a chamber maintained in a vacuum state; introducing gaseous linear perfluorocarbon as a material of an ink-repellent film into the chamber; and depositing an ink-repellent film made of fluorocarbon resin obtained by subjecting the perfluorocarbon to plasma polymerization on the surface of the head member to perform the ink-repellent treatment.

In the thirteenth aspect, the ink-repellent film high in ink repellency can be formed relatively readily on the ejection surface of the head member.

A fourteenth aspect of the present invention according to the thirteenth aspect is the ink-repellent treatment method characterized in that carbon tetrafluoride is introduced into the chamber together with the perfluorocarbon.

In the fourteenth aspect, the ink-repellent film further excellent in ink repellency can be deposited on the ejection surface of the head member.

A fifteenth aspect of the present invention according to any one of the thirteenth and fourteenth aspects is the ink-repellent treatment method characterized in that the perfluorocarbon has a saturation structure.

In the fifteenth aspect, the number of uncombined hands generated during the polymerization can be reduced more than that of perfluorocarbon of a nonsaturation structure.

A sixteenth aspect of the present invention according to the fifteenth aspect is the ink-repellent treatment method characterized in that the perfluorocarbon contains at least six carbons or more.

In the sixteenth aspect, a molecular weight of the perfluorocarbon as a material of the ink-repellent film can be made relatively heavy, and thus a molecular weight of the fluorocarbon resin formed by the polymerization can be also made heavy.

A seventeenth aspect of the present invention according to the sixteenth aspect is the ink-repellent treatment method characterized in that the perfluorocarbon contains at least eight carbons or more.

In the seventeenth aspect, the perfluorocarbon exists as liquid or gas at a normal temperature. Moreover, since the perfluorocarbon readily becomes gas in a vacuum, heating is not required therefor, and handling thereof can be facilitated when the polymerization treatment is performed.

An eighteenth aspect of the present invention according to any one of the thirteenth to seventeenth aspect is the ink-repellent treatment method characterized in that, after the deposition of the ink-repellent film, process gas is converted into plasma, and the process gas is flown into the ejection ports, thus removing the ink-repellent film in the ejection ports.

In the eighteenth aspect, since the process gas is converted into plasma to remove the fluorocarbon resin, the fluorocarbon resin can be decomposed and removed in an extremely short time. Moreover, since the fluorocarbon resin can be removed in a short time as described above, an influence on the peripheries of the ejection ports can also be decreased. Note that rare gas such as He gas can be preferably used as process gas.

A nineteenth aspect of the present invention according to the eighteenth aspect is the ink-repellent treatment method characterized in that the plasma conversion of the process gas is performed under any of the atmospheric pressure and pressure nearly equal thereto.

In the nineteenth aspect, since an expensive vacuum apparatus is not required for converting the process gas into plasma, the cost can be reduced to be inexpensive. Moreover, evacuation treatment is not required for evacuating a region where the process gas is converted into plasma. Therefore, time required for the treatment of removing the fluorocarbon resin can be shortened.

A twentieth aspect of the present invention according to any one of the eighteenth and nineteenth aspects is the ink-repellent treatment method characterized in that gas is flown into the ejection ports by evacuating on one side of the ejection ports.

In the twentieth aspect, the process gas is evacuated, and thus the process gas is flown out of the ejection ports without contacting the peripheries of the ejection ports. Therefore, the fluorocarbon resin in the ejection ports can be removed without affecting the peripheries of the ejection ports.

A twenty-first aspect of the present invention according to any one of the eighteenth to twentieth aspects is the ink-repellent treatment method characterized in that the process gas is flown into the ejection ports from a surface side of the nozzle plate without the ink-repellent film formed thereon.

In the twenty-first aspect, the fluorocarbon resin in the ejection ports can be removed without affecting the peripheries of the ejection ports.

A twenty-second aspect of the present invention according to any one of the thirteenth to seventeenth aspects is the ink-repellent treatment method characterized in that, after the deposition of the ink-repellent film, ultraviolet rays are radiated into the ejection ports to remove the ink-repellent film in the ejection ports.

In the twenty-second aspect, since the ultraviolet rays have strong rectilinear properties, they can be radiated only in regions inside the ejection ports. Therefore, there is no possibility of affecting the peripheries of the ejection ports. Moreover, since the ultraviolet rays are attenuated in a short period of time even if they are reflected inside the ejection ports, there is no possibility that the reflected ultraviolet rays affect the peripheries of the ejection ports. As such ultraviolet rays, one having a wavelength of 380 nm or shorter is desirable, and one having a wavelength of 200 nm or shorter is more desirable. In this case, in order to reduce scattering or absorption of the ultraviolet rays, it is desirable that radiation paths of the ultraviolet rays leading into the ejection ports be set in a vacuum state.

A twenty-third aspect of the present invention according to the twenty-second aspect is the ink-repellent treatment method characterized in that the ultraviolet rays are radiated into the ejection ports from the surface side of the nozzle plate without the ink-repellent film formed thereon.

In the twenty-third aspect, the fluorocarbon resin in the ejection ports can be removed without affecting the peripheries of the ejection ports.

A twenty-fourth aspect of the present invention according to any one of the thirteenth to seventeenth aspects is the ink-repellent treatment method characterized in that, after the deposition of the ink-repellent film, electron beams are radiated into the ejection ports to remove the ink-repellent film in the ejection ports.

In the twenty-fourth aspect, since the electron beams are excellent in rectilinear properties and can be handled relatively readily, the fluorocarbon resin can be removed with good accuracy. Moreover, the fluorocarbon resin can be removed in an extremely short time. In this case, in order to increase rectilinear distance of the electron beams, it is desirable that radiation paths of the electron beams leading into the ejection ports be set in a vacuum state.

A twenty-fifth aspect of the present invention according to the twenty-fourth aspect is the ink-repellent treatment method characterized in that the electron beams are radiated into the ejection ports from the surface side of the nozzle plate without the ink-repellent film formed thereon.

In the twenty-fifth aspect, the fluorocarbon resin in the ejection ports can be removed without affecting the peripheries of the ejection ports.

A twenty-sixth aspect of the present invention is an ink-repellent treatment apparatus, comprising: a chamber for disposing a head member therein; vacuum means for evacuating the chamber; a discharge unit for discharging plasma in the chamber; and supply means for introducing gaseous linear perfluorocarbon into the chamber.

In the twenty-sixth aspect, the linear perfluorocarbon is introduced into the chamber, and is converted into plasma by the discharge unit of the chamber. And, the linear perfluorocarbon is subjected to the plasma polymerization on the ejection surface of the head member, and the ink-repellent film made of the fluorocarbon resin can be formed. Moreover, since the chamber is maintained in a vacuum state by the vacuum means at this time, there is no possibility that water molecules or the like contained in the atmosphere are attached to the perfluorocarbon during the plasma polymerization. Therefore, the ink-repellent film high in ink repellency can be formed on the ejection surface of the head member. Moreover, the time can be shortened to a great extent in comparison with that in the case of the eutectoid plating. Note that, in order to readily generate gaseous discharges, it is preferable to introduce inert gas such as Argon gas into the chamber.

A twenty-seventh aspect of the present invention according to the twenty-sixth aspect is the ink-repellent treatment apparatus characterized in that a supply source for introducing carbon tetrafluoride into the chamber together with the linear perfluorocarbon is provided.

In the twenty-seventh aspect, the carbon tetrafluoride introduced in the chamber is converted into plasma, and a large number of active fluorine radicals are generated.

A twenty-eighth aspect of the present invention according to any one of the twenty-sixth and twenty-seventh aspects is the ink-repellent treatment apparatus characterized in that the perfluorocarbon has a saturation structure.

In the twenty-eighth aspect, the number of uncombined hands generated during the polymerization can be reduced more than that of the perfluorocarbon of the nonsaturation structure.

A twenty-ninth aspect of the present invention according to the twenty-eighth aspect is the ink-repellent treatment apparatus characterized in that the perfluorocarbon contains at least six carbons or more.

In the twenty-ninth aspect, a molecular weight of the perfluorocarbon as a material of the ink-repellent film can be made relatively heavy, and thus a molecular weight of the fluorocarbon resin formed by the polymerization can be also made heavy.

A thirtieth aspect of the present invention according to the twenty-ninth aspect is the ink-repellent treatment apparatus characterized in that the perfluorocarbon contains at least eight carbons or more.

In the thirtieth aspect, the perfluorocarbon exists as liquid or gas at a normal temperature. Moreover, since the perfluorocarbon readily becomes gas in a vacuum, heating is not required therefor, and handling thereof can be facilitated when the polymerization treatment is performed.

A thirty-first aspect of the present invention according to any one of the twenty-sixth to thirtieth aspects is the ink-repellent treatment apparatus characterized in that a dew condensation prevention heater is provided on an introduction path of the perfluorocarbon leading into the chamber to enable the perfluorocarbon to be heated.

In the thirty-first aspect, there is no possibility that dew is generated during the polymerization treatment to slow down a treatment rate thereof.

A thirty-second aspect of the present invention according to any one of the twenty-sixth to thirty-first aspects is the ink-repellent treatment apparatus characterized in that temperature maintaining means for maintaining the head member in the chamber at a constant temperature.

In the thirty-second aspect, the head member is maintained at a constant temperature, and the fluorocarbon resin are thus apt to be coagulated on the head member; hence, deposition of the ink-repellent film formed on the head member can be accelerated.

A thirty-third aspect of the present invention is an in-micropore fluorine plastic removing method for removing fluorocarbon resin in micropores of a work, the micropores being provided by penetrating the work in a thickness direction, characterized in that process gas converted into plasma is flown into the micropores from one aperture surface side of the micropores to remove the fluorocarbon resin in the micropores.

In the thirty-third aspect, the ink-repellent film made of the fluorocarbon resin can be decomposed and removed in an extremely short time.

A thirty-fourth aspect of the present invention according to the thirty-third aspect is the in-micropore fluorine plastic removing method characterized in that a fluorine plastic film is formed on one surface of the work.

In the thirty-fourth aspect, only the fluorocarbon resin in the micropores are removed without removing the fluorine plastic film formed on the surface of the work.

A thirty-fifth aspect of the present invention according to the thirty-fourth aspect is the in-micropore fluorine plastic removing method characterized in that the process gas is flown into the micropores from a surface side of the work without the fluorocarbon resin formed thereon.

In the thirty-fifth aspect, the fluorocarbon resin in the ejection ports can be removed without affecting the peripheries of the micropores.

A thirty-sixth aspect of the present invention according to any one of the thirty-third to thirty-fifth aspects is the in-micropore fluorine plastic removing method characterized in that the plasma conversion of the process gas is performed under any of the atmospheric pressure and pressure nearly equal thereto.

In the thirty-sixth aspect, since an expensive vacuum apparatus is not required for converting the process gas into plasma, the cost can be reduced to be inexpensive. Moreover, evacuation treatment is not required for evacuating a region where the process gas is converted into plasma. Therefore, time required for the treatment of removing the fluorocarbon resin can be shortened.

A thirty-seventh aspect of the present invention according to any one of the thirty-third to thirty-sixth aspects is the in-micropore fluorine plastic removing method characterized in that gas is flown into the micropores by evacuating on one side of the micropores.

In the thirty-seventh aspect, the process gas is evacuated, and the process gas is thus flown out of the micropores without contacting the peripheries of the micropores. Therefore, the fluorocarbon resin in the ejection ports can be removed without affecting the peripheries of the micropores.

A thirty-eighth aspect of the present invention is an in-micropore fluorine plastic removing method for removing fluorocarbon resin in micropores of a work, the micropores being provided by penetrating the work in a thickness direction, characterized in that ultraviolet rays are radiated from one aperture surface side of the micropores to remove the fluorocarbon resin in the micropores.

In the thirty-eighth aspect, since the ultraviolet rays have strong rectilinear properties, they can be radiated only in regions inside the ejection ports. Therefore, there is no possibility of affecting the peripheries of the ejection ports. Moreover, since the ultraviolet rays are attenuated in a short period of time even if they are reflected inside the ejection ports, there is no possibility that the reflected ultraviolet rays affect the peripheries of the ejection ports. As such ultraviolet rays, one having a wavelength of 380 nm or shorter is desirable, and one having a wavelength of 200 nm or shorter is more desirable. In this case, in order to reduce scattering or absorption of the ultraviolet rays, it is desirable that radiation paths of the ultraviolet rays leading into the ejection ports be set in a vacuum state.

A thirty-ninth aspect of the present invention according to the thirty-eighth aspect is the in-micropore fluorine plastic removing method, characterized in that a fluorine plastic film is formed on one surface of the work.

In the thirty-ninth aspect, only the fluorocarbon resin in the micropores are removed without removing the fluorine plastic film formed on the surface of the work.

A fortieth aspect of the present invention according to the thirty-ninth aspect is the in-micropore fluorine plastic removing method, characterized in that the ultraviolet rays are radiated into the micropores from a surface side of the work without the fluorocarbon resin formed thereon.

In the fortieth aspect, since the ultraviolet rays can be radiated only in the regions inside the ejection ports, the ink-repellent film can be removed without affecting the peripheries of the ejection ports.

A forty-first aspect of the present invention is an in-micropore fluorine plastic removing method for removing fluorocarbon resin in micropores of a work, the micropores being provided by penetrating the work in a thickness direction, characterized in that electron beams are radiated from one aperture surface side of the micropores to remove the fluorocarbon resin in the micropores.

In the forty-first aspect, since the electron beams are excellent in rectilinear properties and can be handled relatively readily, the fluorocarbon resin can be removed with good accuracy. Moreover, the fluorocarbon resin can be removed in an extremely short time. In this case, in order to increase rectilinear distance of the electron beams, it is desirable that radiation paths of the electron beams leading into the micro ports be set in a vacuum state.

A forty-second aspect of the present invention according to the forty-first aspect is the in-micropore fluorine plastic removing method, characterized in that a fluorine plastic film is formed on one surface of the work.

In the forty-second aspect, only the fluorocarbon resin in the micropores are removed without removing the fluorine plastic film formed on the surface of the work.

A forty-third aspect of the present invention according to the forty-second aspect is the in-micropore fluorine plastic removing method, characterized in that the electron beams are radiated into the micropores from a surface side of the work without the fluorocarbon resin formed thereon.

In the forty-third aspect, the fluorocarbon resin in the micro ports can be removed without affecting the peripheries of the micropores.

A forty-fourth aspect of the present invention is an in-micropore fluorine plastic removing apparatus, comprising: supply means for supplying process gas to one side of a work having micropores in a penetrating direction of the micropores; plasma generating means for converting the process gas into plasma under any of the atmospheric pressure and pressure nearly equal thereto; an evacuator for evacuating the process gas converted into plasma through the micropores of the work, the evacuator being disposed on the other side of the work; and evacuating means connected to the evacuator.

In the forty-fourth aspect, the fluorocarbon resin can be decomposed and removed in an extremely short time. Moreover, since the fluorocarbon resin can be removed in a short time as described above, an influence on the peripheries of the micropores can be decreased.

A forty-fifth aspect of the present invention according to the forty-fourth aspect is the in-micropore fluorine plastic removing apparatus, characterized in that the evacuator consists of a porous member adhered to the work.

In the forty-fifth aspect, the process gas is evacuated through the porous member, and the work is evacuated and held by the evacuator.

A forty-sixth aspect of the present invention according to any one of the forty-fourth and forty-fifth aspects is the in-micropore fluorine plastic removing apparatus, characterized in that the evacuator also serves as the other electrode constituting a pair with one electrode of the plasma generating means, the one electrode being disposed at one side of the work.

In the forty-sixth aspect, an influence of the process gas on the peripheries of the micropores can be restrained when the fluorocarbon resin are removed.

A forty-seventh aspect of the present invention is an in-micropore fluorine plastic removing apparatus, comprising: a chamber disposing therein a work having micropores; pressure reducing means for reducing pressure of the chamber; and ultraviolet-ray radiating means for radiating ultraviolet rays into the micropores of the work.

In the forty-seventh aspect, since the ultraviolet rays can be radiated only in the regions inside the micropores, the fluorocarbon resin can be removed without affecting the peripheries of the micropores.

A forty-eighth aspect of the present invention is an in-micropore fluorine plastic removing apparatus, comprising: a chamber disposing therein a work having micropores; pressure reducing means for reducing pressure of the chamber; and electron-beam radiating means for radiating electron beams into the micropores of the work.

In the forty-eighth aspect, the electron beams can be radiated into the micropores in a state in which the radiation paths of the electron beams are set in vacuum, thus making it possible to remove the fluorocarbon resin with good accuracy.

In the head member of the present invention, on the surface thereof, the ink-repellent film made of the fluorocarbon resin subjected to the plasma polymerization is formed. Specifically, on the surface of the head member, an underlayer made of other material does not exist, and only the ink-repellent film made of the fluorocarbon resin is formed directly on the head member with good adhesion.

It is preferable that the ink-repellent film as described above be formed by plasma polymerization of the linear perfluorocarbon. Furthermore, it is more preferable that specified quantities of the linear perfluorocarbon and carbon tetrafluoride be introduced into the chamber and mixed therein, followed by being subjected to the plasma polymerization. In a manner as described above, the carbon tetrafluoride introduced into the chamber is converted into plasma, and a large number of active fluorine radicals are generated. Therefore, the fluorine radicals can be bonded with the uncombined hands generated during the polymerization of the perfluorocarbon. Hence, the ratio of the hydroxyl group or the hydrogen atoms in the ink-repellent film made of the formed fluorocarbon resin can be greatly decreased, and the ratio of the fluorine in the ink-repellent film can be increased.

Moreover, the carbon tetrafluoride can be used in forming fluorocarbon resin with a heavy molecular weight by polymerization of the perfluorocarbon, and at the same time, can be used for etching treatment of fluorocarbon resin with a light molecular weight. Therefore, an ink-repellent film made of fluorocarbon resin with a heavy molecular weight as a whole can be formed.

Therefore, the ink-repellent film excellent in ink repellency can be deposited on the ejection surface, and the remaining ink can be prevented from attaching onto the ejection surface. Moreover, since the uncombined hands of the ink-repellent film are bonded with the fluorine radicals as described above, there is no possibility that the fluorocarbon resin are oxidized even in the atmosphere.

It is preferable that the perfluorocarbon used in the present invention has a saturation structure. Thus, the number of the uncombined hands generated during the polymerization can be more reduced than that of the perfluorocarbon of a nonsaturation structure. Accordingly, the ratio of the uncombined hands bonded with the foregoing hydroxyl groups or hydrogen atoms can be further decreased, and accompanied with this, the polymerization degree can be increased. Thus, ink-repellent efficiency can be further enhanced.

Moreover, it is preferable that the perfluorocarbon used in the present invention has at least six carbons or more. In a manner as described above, the molecular weight of the perfluorocarbon as a material of the ink-repellent film is set relatively heavy, and accordingly, the molecular weight of the fluorocarbon resin formed by the polymerization can be made heavy. Moreover, since the ink-repellent film can be formed of the fluorocarbon resin with a heavy molecular weight as described above, the ink repellent efficiency can be enhanced. Furthermore, it is more preferable that the perfluorocarbon has eight carbons or more. Such perfluorocarbon exists as liquid or gas at a normal temperature. Moreover, since the perfluorocarbon readily becomes gas in a vacuum, heating is not required therefor, and handling thereof can be facilitated when the polymerization treatment is performed.

BEST MODE FOR CARRYING OUT THE PRESENT INVENTION

Hereinbelow, description will be made in detail for embodiments of the present invention with reference to the drawings.

Embodiment 1

Figure 1:
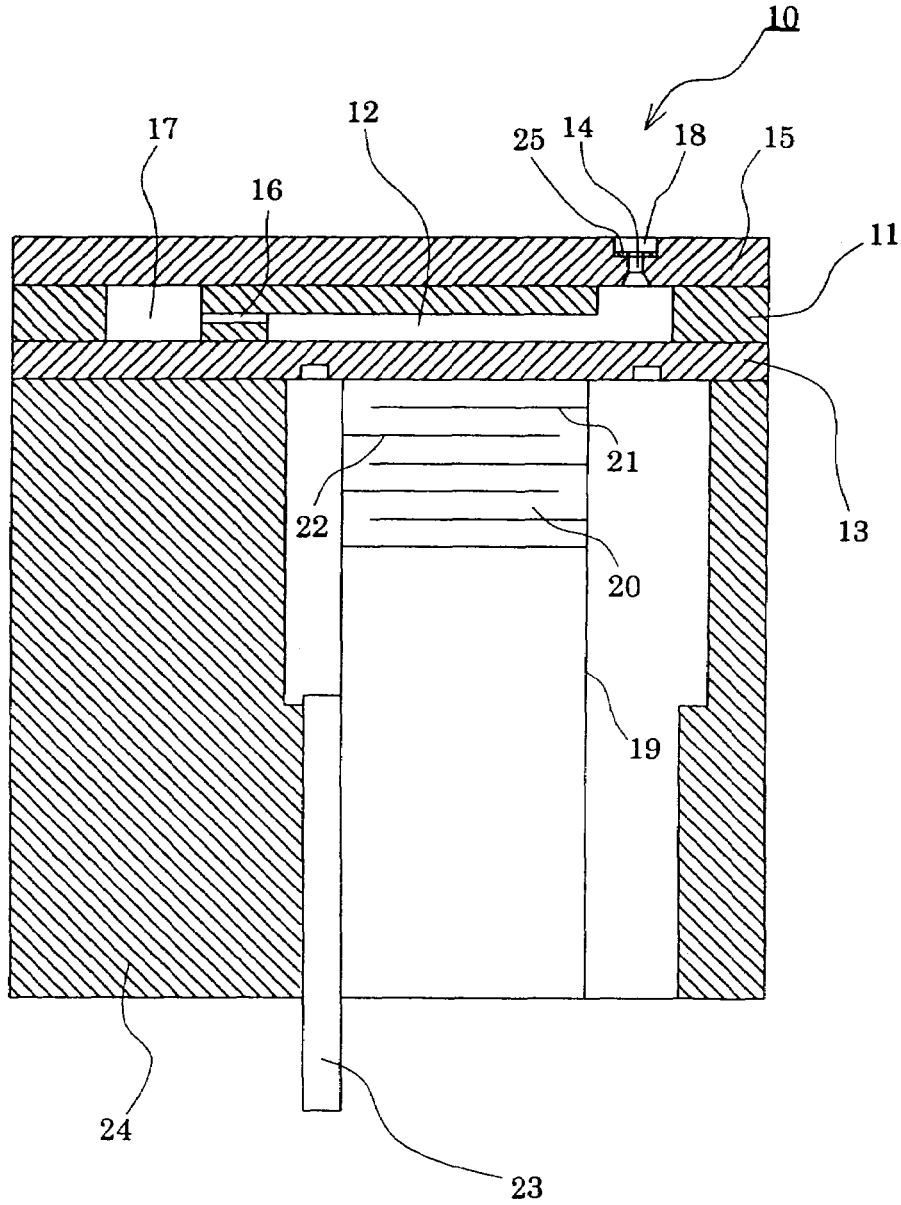
FIG. 1 is a sectional view schematically showing an ink-jet recording head according to an embodiment 1 of the present invention.

FIG. 1 is a sectional view of an ink-jet recording head according to an embodiment 1 of the present invention.

First, description will be made for the ink-jet recording head according to this embodiment. The ink-jet recording head 10 according to this embodiment is an ink-jet recording head of a longitudinal displacement type. As shown in FIG. 1, a plurality of pressure generating chambers 12 are parallelly provided in a spacer 11 consisting of, for example, a single crystal silicon substrate. One surface of this spacer 11 is sealed by an elastic plate 13, and the other surface is sealed by a head member of this embodiment, that is, a nozzle plate 15 having a plurality of ejection ports 14. Moreover, in the spacer 11, a reservoir 17 communicating with the pressure generating chambers 12 through ink supply ports 16 is formed, and an ink tank (not shown) is connected to the reservoir 17.

Here, the nozzle plate of this embodiment is made of, for example, stainless steel (SUS), and the plurality of ejection ports 14, each having a diameter of about 20 μm, are drilled in at specified positions thereon. Moreover, though these ejection ports 14 are basically formed to be approximately straight, they are formed so that each diameter can be gradually increased in the vicinity of an end portion on an ink introducing side. Moreover, in regions of the one surface of the nozzle plate 15 corresponding to the respective ejection ports 14, craters 18 obtained by removing a part of the nozzle plate 15 in a thickness direction are provided respectively, and by the craters 18, peripheries of the ejection ports 14 are protected. Note that, as a matter of course, the craters 18 may be continuously provided in regions facing the plurality of ejection ports 14.

Meanwhile, a tip of a piezoelectric element 19 abuts on an opposite side of the elastic plate 13 with the pressure generating chambers 12. The piezoelectric element 19 is constituted in such a manner that a piezoelectric material 20 and electrode forming materials 21 and 22 alternately sandwich each other to form a laminated structure, and an inactive region not contributing to vibrations is fixedly attached to a fixed plate 23. Note that the fixed plate 23, the elastic plate 13, the spacer 11 and the nozzle plate 15 are fixed integrally by interposing a base stage 24.

In the ink-jet recording head 10 thus constituted, since the piezoelectric element 19 extends toward the nozzle plate 15 when a voltage is applied to the electrode forming materials 20 and 22 of the piezoelectric element 19, the elastic plate 13 is displaced, and a volume of the pressure generating chamber 12 is compressed. Hence, for example, it is possible to remove a voltage in a state where a bias voltage of about 30V is applied in advance and to make the piezoelectric element 19 shrink, thus causing the ink to flow from the reservoir 17 through the ink supply port 16 into the pressure generating chamber 12. And thereafter, by applying a voltage, the piezoelectric element 19 is extended, the pressure generating chamber 12 is shrunk by the elastic plate 13, and ink droplets are ejected from the ejection port 14.

Moreover, the surface of the nozzle plate 15 of this embodiment is subjected to the ink-repellent treatment. Specifically, in the regions on the surface of the nozzle plate 15 corresponding to each of the ejection ports 14, that is, on a bottom surface of each of the craters 18, there is formed an ink-repellent film 25 made of the fluorocarbon resin subjected to the plasma polymerization on the surface of the nozzle plate 15.

Accordingly, on the surface of the nozzle plate 15, an underlayer made of other material does not exist, and only the ink-repellent films 25 made of the fluorocarbon resin are formed directly on the nozzle plate 15 with good adhesion.

As described above, the ink-repellent films 25 are provided on the surface of the nozzle plate 15, the ink-repellent films 25 excellent in ink repellency can be thus deposited on the surface of the nozzle plate 15, and the remaining ink can be prevented from becoming attached to the surface of the nozzle plate 15. Hence, ink ejection characteristics can be always well maintained.

Moreover, in this embodiment, since the ink-repellent films 25 made of the fluorocarbon resin subjected to the plasma polymerization are provided on the surface of the nozzle plate 15 without providing an underlayer thereto, the ink repellency of the ink-repellent films 25 can be improved, and the adhesion and the durability can be improved as well.

Note that, in a manufacturing process of the ink-repellent film 25, though the ink-repellent film 25 is formed in the ejection port 14, it is preferable that the ink-repellent film does not exist in the ejection port 14. Therefore, in this embodiment, the ink-repellent film in the ejection port 14 is removed. As described above, by inhibiting the existence of the ink-repellent film in the ejection port 14, the ink ejection characteristics can be well maintained. Description will be made below in detail for the method for removing the ink-repellent film formed in the ejection port 14.

Moreover, in this embodiment, the ink-repellent films 25 is provided in the region on the surface of the nozzle plate 15, facing the ejection ports 14; however, as a matter of course, the ink-repellent film may be provided on the entire surface of the nozzle plate 15.

Here, description will be made for the method for forming such an ink-repellent film 25.

Figure 2:
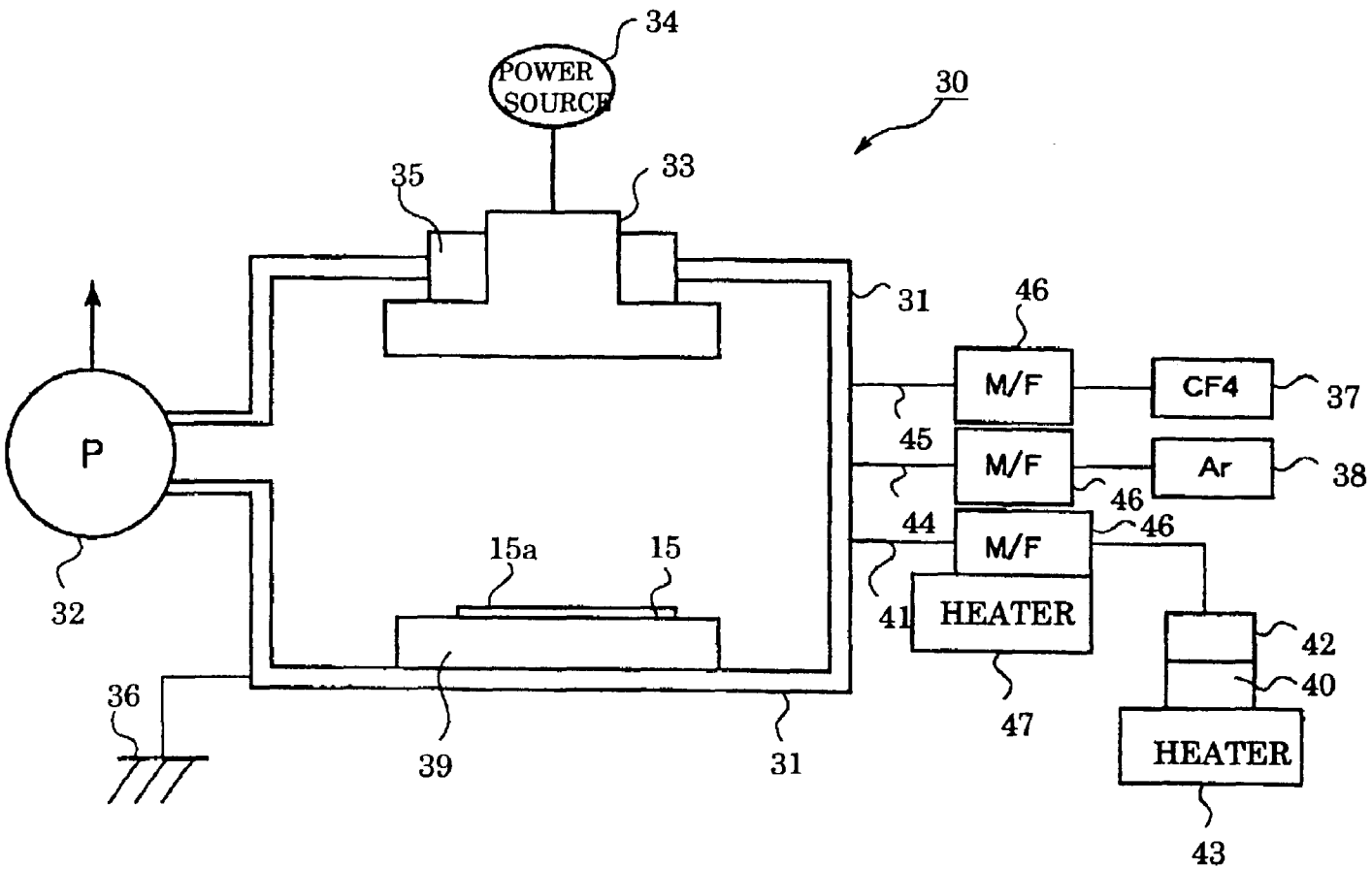
FIG. 2 is a schematic sectional view of an ink-repellent treatment apparatus according to the embodiment 1 of the present invention.

First, description will be made for an ink-repellent treatment apparatus 30 used in forming the ink-repellent film 25. As shown in FIG. 2, the ink-repellent treatment apparatus 30 has a vacuum chamber 31 as a chamber for performing the ink-repellent treatment therein. This vacuum chamber 31 is connected to a vacuum pump 32 as vacuum means, and inside of the vacuum chamber 31 can be maintained at a pressure of about 133 Pa (1 Torr) by the vacuum pump 32. As described above, by maintaining the inside of the vacuum chamber 31 vacuum, water molecules and the like contained in the atmosphere are eliminated, and the ink-repellent treatment can be performed.

Moreover, in an upper surface of the vacuum chamber 31, a high-frequency electrode 33 as a discharge unit having a convex-shaped section is inserted. The high-frequency electrode 33 is connected to a high-frequency power source 34 provided outside the vacuum chamber 31, and by this high-frequency power source 34, a voltage is applied to the high-frequency electrode 33. A high frequency of about 13.56 MHz is used in this embodiment; however, the frequency can be changed according to purposes. And, the high-frequency electrode 33 is disposed in the vacuum chamber 31, interposing an insulator 35. Since the insulator 35 is interposed as described above, insulation between the high-frequency electrode 33 to which a voltage is applied from the high-frequency power source 34 and the vacuum chamber 31 can be secured. Meanwhile, a wall surface of the vacuum chamber 31 is connected to an earth 36. Thus, the wall surface of the vacuum chamber 31 can secure grounding. Therefore, a high voltage can be applied to carbon tetrafluoride 37 and argon 38 that are introduced into the vacuum chamber 31 to convert the same into plasma.

Moreover, on a floor surface of the vacuum chamber 31, the nozzle plate 15 is disposed interposing a cooling stage 39 as temperature maintaining means. The cooling stage 39 has cooling water flown therein, and by the cooling water, the nozzle plate 15 disposed on the cooling stage 39 is cooled and maintained at a constant temperature. As described above, the nozzle plate 15 is disposed on the grounding electrode side, and the ink-repellent film 25 made of the fluorocarbon resin subjected to the plasma polymerization can be thus formed on an ink ejection surface 15*a* of the nozzle plate 15. In this embodiment, the surface of the nozzle plate 15 is cooled and maintained at a temperature of about 25° C. by the cooling stage 39. Thus, coagulation of the ink-repellent film 25 onto the surface (ejection surface 15*a*) of the nozzle plate 15 is accelerated.

Note that, in this embodiment, the cooling means for cooling and maintaining the nozzle plate 15 is provided as the temperature maintaining means; however, instead of the cooling means, or in addition to the cooling means, heating means such as a heater for maintaining the nozzle plate 15 at a temperature higher than a normal temperature may be provided. In the case of providing the heating means, the surface of the nozzle plate 15 is maintained at a relatively high temperature such as, for example, a constant temperature of about 60° C. Thus, the coagulation of the ink-repellent film 25 is accelerated, and time required for deposition can be shortened.

Therefore, it is possible to introduce perfluorocarbon 40 as an ink-repellent material into the vacuum chamber 31 through a flow passage 41. In this embodiment, $C_8F_{18}$ is used as the perfluorocarbon 40. The perfluorocarbon 40 is disposed in a liquid state in a container 42 to serve as supplying means. A heater 43 is provided under the container 42, and the perfluorocarbon 40 in the container 42 can be heated by the heater 43. The container 42 is connected to the vacuum chamber 31 by the flow passage 41, and is maintained at a pressure much lower than the atmospheric pressure. Therefore, the perfluorocarbon 40 can be gasified at a temperature lower than that of the atmospheric pressure. In this embodiment, by heating the perfluorocarbon 40 to about 50° C. by the heater 43, the perfluorocarbon 40 can be gasified. To an upper portion of the foregoing container 42, one end of the flow passage 41 is connected, and the other end is connected to the vacuum chamber 31. Therefore, the gasified perfluorocarbon 40 in the container 42 can be evacuated by negative pressure on the vacuum chamber 31 side and then introduced into the vacuum chamber 31 through the flow passage 41. Moreover, to the vacuum chamber 31, a flow passage 44 and a flow passage 45 that are similar to the flow passage 41 are connected, and the flow passage 44 and the flow passage 45 are respectively connected to supply sources of the carbon tetrafluoride ($CF_4$) 37 and the argon (Ar) 38. And, similarly to the perfluorocarbon 40, the carbon tetrafluoride 37 and the argon 38 can be introduced into the vacuum chamber 31.

Moreover, mass flow control valves 46 are provided in the respective flow passages 41, 44 and 45, and the mass flows of the respective gases flowing into the vacuum chamber 31 can be adjusted according to needs. And, in the mass flow control valve 46 for the perfluorocarbon 40, a dew condensation prevention heater 47 is provided. Thus, the perfluorocarbon 40 can be prevented from condensing in the vacuum chamber 31. In this embodiment, the dew condensation prevention heater 47 heats the flow passage 41 to a temperature of about 80° C.

An operation of the ink-repellent treatment apparatus 30 thus constituted is as follows. The perfluorocarbon 40 in the container 42 is heated to about 50° C. by the heater 43. As described above, since the container 42 is connected to the vacuum chamber 31 to have negative pressure, the perfluorocarbon 40 can be readily gasified by being heated at about 50° C. In this embodiment, since $C_8F_{18}$ used as the perfluorocarbon has eight or more carbons, $C_8F_{18}$ exists as liquid or gas at a normal temperature. Moreover, since it readily becomes gas in the vacuum, heating therefor is not required, thus making it possible to facilitate handling thereof in the polymerization treatment. At this time, the perfluorocarbon 40 is heated to the temperature of about 80° C. at which the dew condensation can be prevented by the dew condensation prevention heater 47, and then introduced into the vacuum chamber 31. Then, in addition to the perfluorocarbon 40, the carbon tetrafluoride 37 and the argon 38 are introduced into the vacuum chamber 31, respectively.

Figure 3:
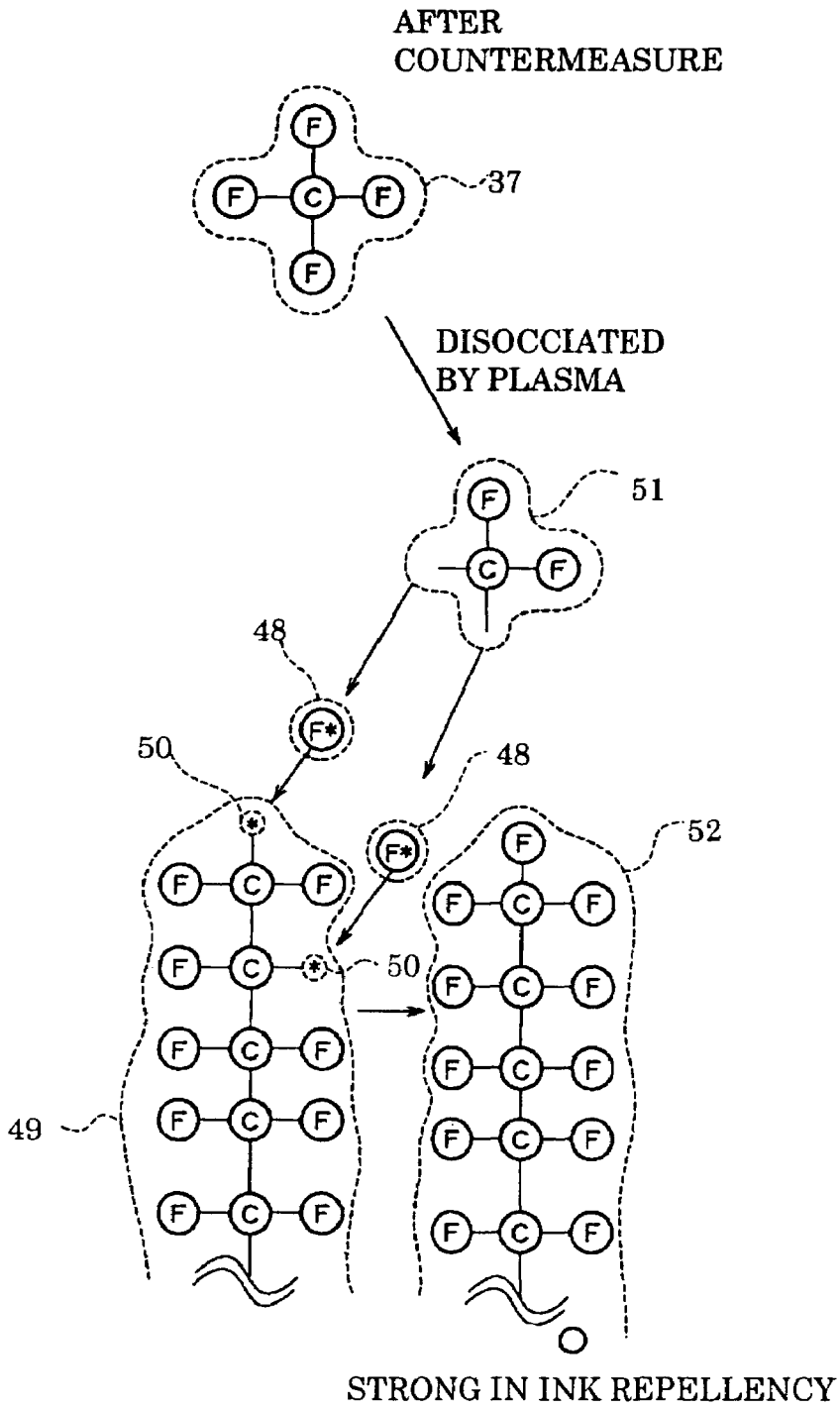
FIG. 3 is a process view showing plasma polymerization in the embodiment 1 of the present invention.

FIG. 3 is a process view showing plasma polymerization in this embodiment. As described above, since a high-frequency voltage is applied into the vacuum chamber 31, the perfluorocarbon 40, the carbon tetrafluoride 37 and the argon 38 that are introduced into the vacuum chamber 31 are converted into plasma, and plasma particles such as argon radicals and fluorine radicals 48 are generated. Such plasma particles cut portions where bonds of the perfluorocarbon 40 are weak and cause a polymerization reaction.

Specifically, as shown in FIG. 3, the polymerization reaction is generated in the perfluorocarbon 40 by the plasma particles, and fluorocarbon resin 49 are thus formed. In this embodiment, since $C_8F_{18}$ used as the perfluorocarbon 40 has six or more carbons, a molecular weight of the fluorocarbon resin 49 formed during the polymerization can be also increased.

Moreover, as shown in FIG. 3, uncombined hands 50 without combination partners are generated during the polymerization; however, since $C_8F_{18}$ is linear and has a saturation structure, a ratio of the uncombined hands generated during the polymerization can be reduced in comparison with a circular one or one with an unsaturation structure. As described above, the plasma polymerization is performed in the vacuum, and thus the fluorocarbon resin 49 with a heavy molecular weight can be formed since there is no possibility that the polymerization reaction is interrupted by a hydroxyl group or hydrogen atoms in the atmosphere. Furthermore, since the linear perfluorocarbon $C_8F_{18}$ is used as the perfluorocarbon 40, linear fluorocarbon resin 49 can be formed.

Moreover, the carbon tetrafluoride 37 is dissociated at this time, for example, into an active free radical 51 and fluorine radicals 48 as shown in FIG. 3. Each fluorine radical 48 is bonded with each of the uncombined hands 50, thus increasing a fluorine content of formed fluorocarbon resin 52, and at the same time, contents of the hydroxyl group or the hydrogen atoms can be reduced. Moreover, an oxidation reaction of the fluorocarbon resin 52 can be prevented. Thus, the ink repellency of the formed fluorocarbon resin 52 can be enhanced. Furthermore, the carbon tetrafluoride 37 polymerizes the perfluorocarbon 40 to form the fluorocarbon resin 52 with a heavy molecular weight, and at the same time, fluorocarbon resin with a light molecular weight can be subjected to etching treatment. Accordingly, the fluorocarbon resin 52 with a heavy molecular weight can be deposited as a whole. Therefore, the ink-repellent film 25 made of the fluorocarbon resin with excellent ink repellency can be deposited on the ejection surface 15*a* of the nozzle plate 15, and the remaining ink can be prevented from attaching onto the ejection surface 15*a*.

Figure 4:
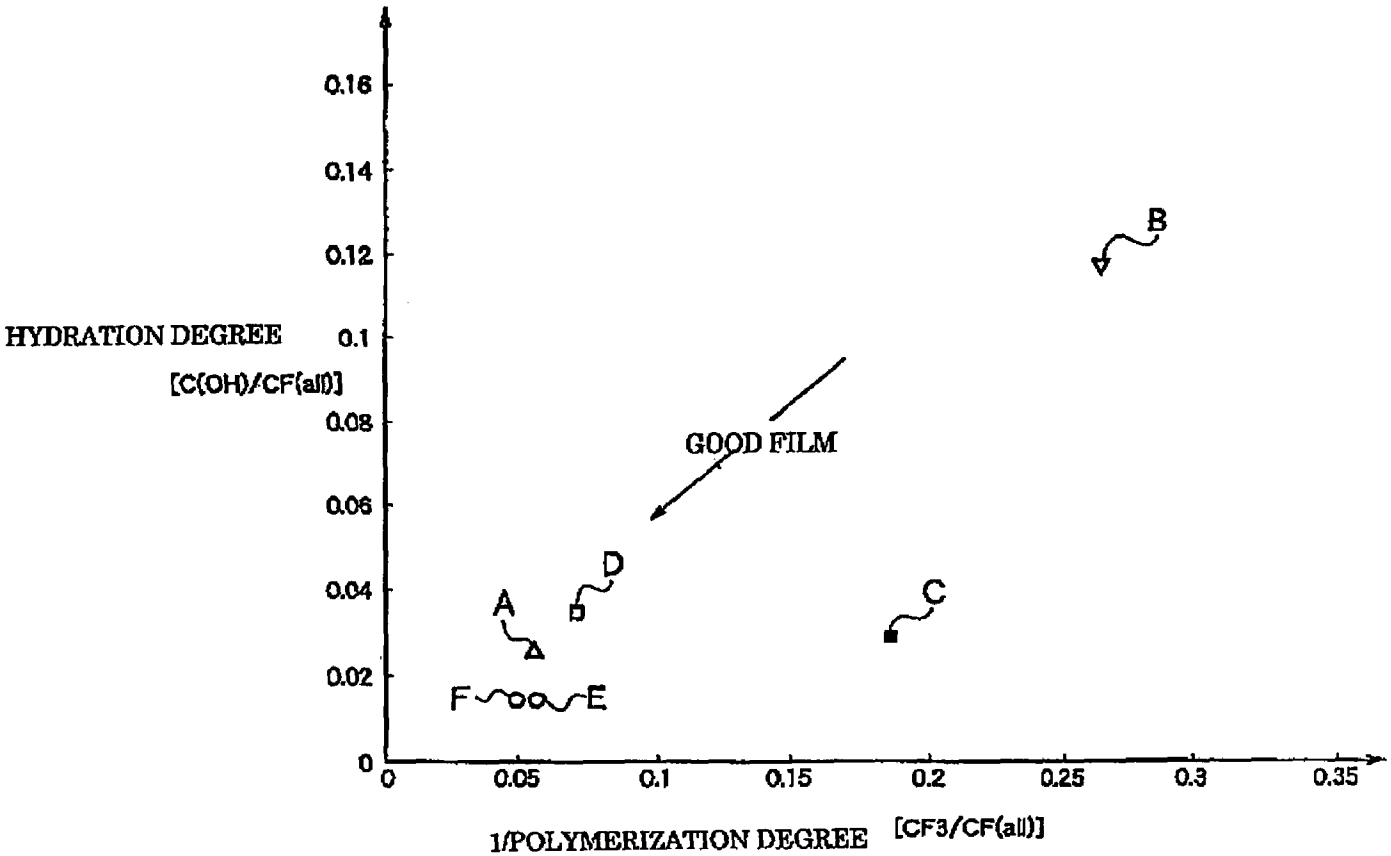
FIG. 4 is an explanatory view showing ink-repellent performance of an ink-repellent film.
Figure 5:
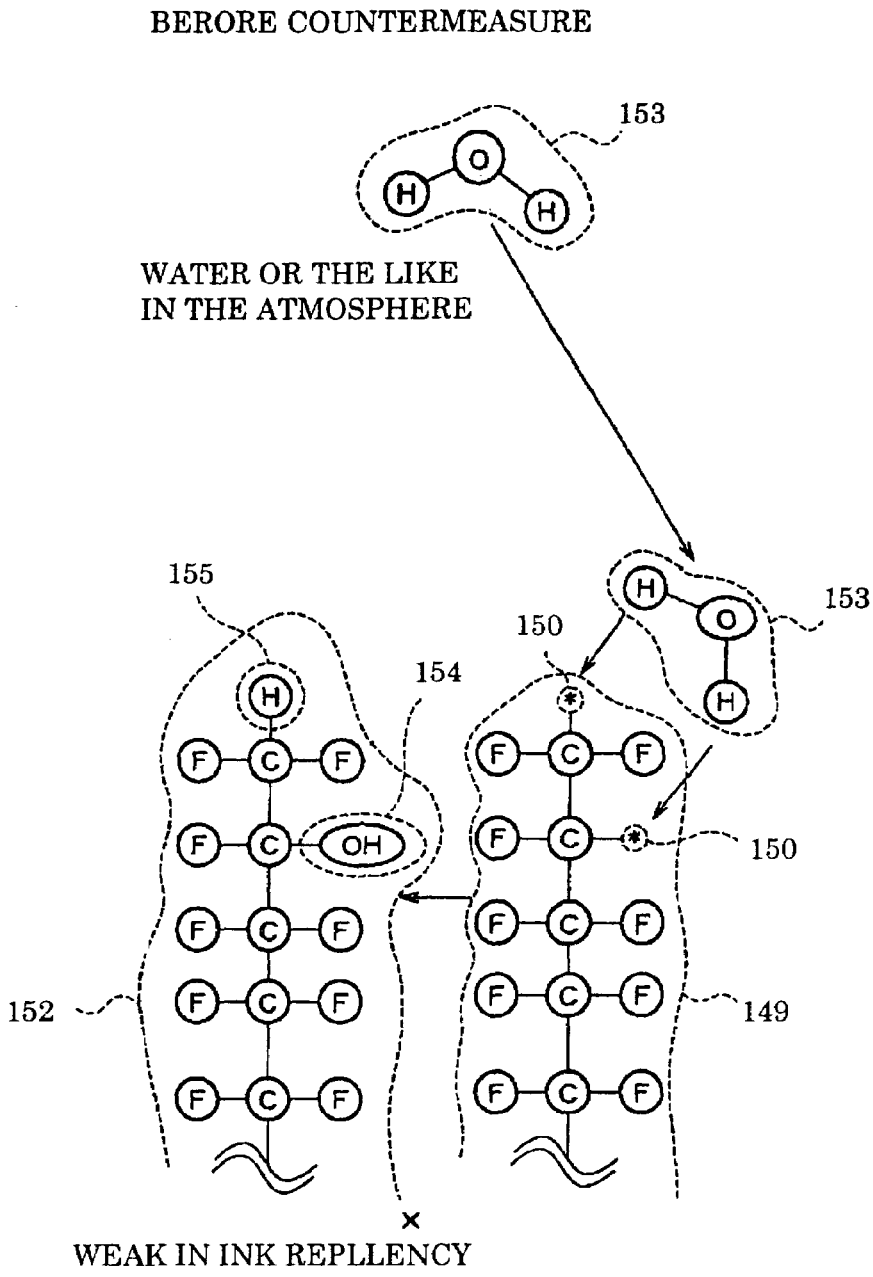
FIG. 5 is an explanatory view showing a problem of the plasma polymerization in the atmosphere.

FIG. 4 is an explanatory view showing whether the performance of the deposited ink-repellent film is good or bad. In an axis of ordinates in FIG. 4, a ratio of the hydroxyl groups contained in the entire formed ink-repellent film (hereinbelow referred to as "hydration degree") is indicated. And, in an axis of abscissas in FIG. 4, inverse number of polymerization degree (hereinbelow referred to as "relative polymerization degree") is indicated. The inventors of the present invention obtained knowledge that the ink-repellent performance of the ink-repellent film was related to the above-described hydration degree and relative polymerization degree. Specifically, when the hydroxyl groups are contained in the ink-repellent film, the ink repellency is lowered by that amount. Therefore, the lower the ratio of the hydroxyl groups is, that is, the smaller the value of the hydration degree indicated in the axis of ordinates is, the better properties of the ink-repellent film are indicated. Meanwhile, the relative polymerization degree can be obtained by a ratio of $CF_3$ contained in the entire fluorocarbon resin. This is because a $CF_3$ group is bonded with the end of the formed fluorocarbon resin. As described above, the heavier the molecular weight of the formed fluorocarbon resin is, the better the properties of the ink-repellent film are. Specifically, the smaller the value of the relative polymerization degree in the axis of abscissas is, the better the properties of the ink-repellent film will be. Hence, as the value gets closer to the origin, the properties will be better as an ink-repellent film. With reference to FIG. 5, description will be made for the properties of the ink-repellent film formed in this embodiment while presenting examples and comparative examples as below.

COMPARATIVE EXAMPLE 1

The case shown by a reference code A in FIG. 4 will be described. The code A denotes an ink-repellent film formed on the ejection surface of the nozzle plate made of steel (SUS), which is obtained by the eutectoid plating of fluorocarbon resin and nickel. Formation time of this ink-repellent film A is 120 minutes, and electric power of 300 W is applied thereto. A film thickness of this ink-repellent film A is 2 μm. As shown in FIG. 4, the ink-repellent film A thus formed had the hydration degree of about 0.025 and the relative polymerization degree of about 0.06.

COMPARATIVE EXAMPLE 2

The case shown by a reference code B in FIG. 4 will be described. The code B denotes an ink-repellent film formed on the nozzle plate made of steel (SUS), which is obtained by the plasma polymerization of a circular perfluorocarbon $C_4F_8$ in the atmosphere. Formation time of this ink-repellent film B is 20 minutes, and electric power of 500 W is applied thereto. A film thickness of this ink-repellent film B is 0.04 μm. At this time, carbon tetrafluoride is not introduced thereto. As shown in FIG. 4, the ink-repellent film B thus formed had the hydration degree of about 0.115 and the relative polymerization degree of about 0.27.

As described above, in the film B, both of the hydration degree and the relative polymerization degree are greatly increased and the ink repellency is significantly lower when compared with those of the film A, and the inventors of the present invention obtained knowledge as below on this point. FIG. 5 is an explanatory view showing problems on formation of the fluorocarbon resin by the plasma polymerization in the atmosphere. In fluorocarbon resin 149 formed by polymerizing the circular perfluorocarbon, uncombined hands 150 without combination partners are generated as shown in FIG. 5. When a water molecule 153 in the atmosphere contacts such uncombined hands 150, a hydroxyl group 154 and a hydrogen atom 155 are bonded with the uncombined hands 150. Therefore, the formed fluorocarbon resin 152 contain a large amount of the hydroxyl groups 154 and the hydrogen atoms 155, and thus the ink repellency is conceived to be significantly lowered. Moreover, when such fluorocarbon resin 152 contact the air or the like, they are oxidized, and thus the ink repellency is conceived to be lowered. Furthermore, the polymerization reaction is hindered and sometimes halted by such hydroxyl groups 154 and hydrogen atoms 155 bonding with the uncombined hands 150. Therefore, a great variance occurs in the molecular weights of the formed fluorocarbon resin 152, which is conceived also to be a cause of deterioration of the film quality.

EXAMPLE 1

The case shown by a reference code C in FIG. 4 will be described. The code C denotes an ink-repellent film formed on the surface of the nozzle plate made of steel (SUS), which is obtained by the plasma polymerization of a linear perfluorocarbon $C_8F_{18}$ in the vacuum. Formation time of this ink-repellent film C is 20 minutes, and electric power of 200 W is applied thereto. A film thickness of this ink-repellent film C is 0.1 μm. At this time, carbon tetrafluoride is not introduced thereto. As shown in FIG. 4, the ink-repellent film C thus formed had the hydration degree of about 0.025 and the relative polymerization degree of about 0.18.

In the film C, both of the relative polymerization degree and the hydration degree can be greatly reduced and the performance in the ink repellency can be improved when compared with those of the film B. Moreover, the value of the hydration degree is roughly equivalent even in comparison with that of the film A.

EXAMPLE 2

The case shown by a reference code D in FIG. 4 will be described. The code D denotes an ink-repellent film formed on the surface of the nozzle plate, which is obtained by the plasma polymerization of the linear perfluorocarbon $C_8F_{18}$ in the vacuum. Formation time of this ink-repellent film D is 20 minutes, and electric power of 300 W is applied thereto. During the plasma polymerization, carbon tetrafluoride is introduced thereto. A material of the nozzle plate is polyimide, and a film thickness of this ink-repellent film is 0.04 μm. Moreover, the film D is formed as an ink-repellent film on the surface of the nozzle plate in such a manner that the nozzle plate is provided in a treatment chamber differing from the chamber where the perfluorocarbon $C_8F_{18}$ is subjected to the plasma polymerization, and the plasma is introduced to the concerned treatment chamber. As shown in FIG. 4, the ink-repellent film D thus formed had the hydration degree of about 0.035 and the relative polymerization degree of about 0.06.

In the film D, both the relative polymerization degree and the hydration degree can be greatly reduced and the performance in ink repellency can be improved when compared with those of the film B. Moreover, the values of the hydration degree and the relative polymerization degree can be made roughly equivalent even in comparison with those of the film A, and thus the ink repellency can be made equivalent.

EXAMPLE 3

The case shown by a reference code E in FIG. 4 will be described. The code E denotes an ink-repellent film formed on the surface of the nozzle plate, which is obtained by the plasma polymerization of the linear perfluorocarbon $C_8F_{18}$ in the vacuum. Formation time of this ink-repellent film E is 10 minutes, and electric power of 350 W is applied thereto. During the plasma polymerization, carbon tetrafluoride is introduced thereto. A material of the nozzle plate is steel (SUS), and a film thickness of this ink-repellent film E is 0.03 μm. Moreover, as described in the embodiment, the film E is formed as an ink-repellent film in such a manner that the nozzle plate is disposed on one side of the electrode made to discharge plasma and the fluorocarbon resin are formed directly on this nozzle plate. As shown in FIG. 4, the ink-repellent film E thus formed had the hydration degree of about 0.015 and the relative polymerization degree of about 0.06.

In the film E, both of the relative polymerization degree and the hydration degree can be greatly reduced and the performance in ink repellency can be improved when compared with those of the film B. Moreover, the values of the hydration degree and the relative polymerization degree can be made roughly equivalent or higher even in comparison with those of the film A, and the ink repellency can be made roughly equivalent or higher.

EXAMPLE 4

The case shown by a reference code F in FIG. 4 will be described. The code F denotes an ink-repellent film formed on the surface of the nozzle plate, which is obtained by the plasma polymerization of the linear perfluorocarbon $C_8F_{18}$ in the vacuum. Formation time of this ink-repellent film F is 10 minutes, and electric power of 400 W is applied thereto. During the plasma polymerization, carbon tetrafluoride is introduced thereto. A material of the nozzle plate is polyimide, and a film thickness of this ink-repellent film F is 0.02 μm. Moreover, as described in the embodiment, the film F is formed as an ink-repellent film in such a manner that the nozzle plate is disposed on one side of the electrode made to discharge plasma and the fluorocarbon resin are formed directly on this nozzle plate. As shown in FIG. 4, the ink-repellent film F thus formed had the hydration degree of about 0.015 and the relative polymerization degree of about 0.05.

In the film F, both of the relative polymerization degree and the hydration degree can be greatly reduced and the performance in ink repellency can be improved when compared with those of the film B. Moreover, the values in both of the hydration degree and the relative polymerization degree can be reduced even in comparison with those of the film A, and the performance in the ink repellency can be improved more than in the case of the eutectoid plating.

As described above, in the ink-repellent films denoted by the codes C to F, the hydration degree is restrained in a range of 0.2 or lower, and the relative polymerization degree is also restrained in a range of 0.2 or lower. It is understood that the ink repellency of the ink-repellent film can be improved by restraining the hydration degree and the relative polymerization degree of the ink-repellent film to be relatively low in such a manner.

Moreover, in the ink-repellent films denoted by the codes C to F, cleaning of the nozzle plate, which has been a problem in the eutectoid plating, is not required, and thus time and labor therefor can be greatly reduced. Moreover, even if the shape of the ink ejection port is complicated, the ink-repellent film can be formed on the ejection surface. And, the cost can be reduced to about one tenth of the case of the eutectoid plating. Moreover, durability of the ink-repellent film can be improved.

Note that an ink-repellent film 25*a* is sometimes formed in the ejection port 14 of the nozzle plate 15 when the ink-repellent film 25 is formed by the plasma polymerization as described above, and it is preferable that the ink-repellent film 25*a* in the ejection port 14 be removed.

Figure 6:
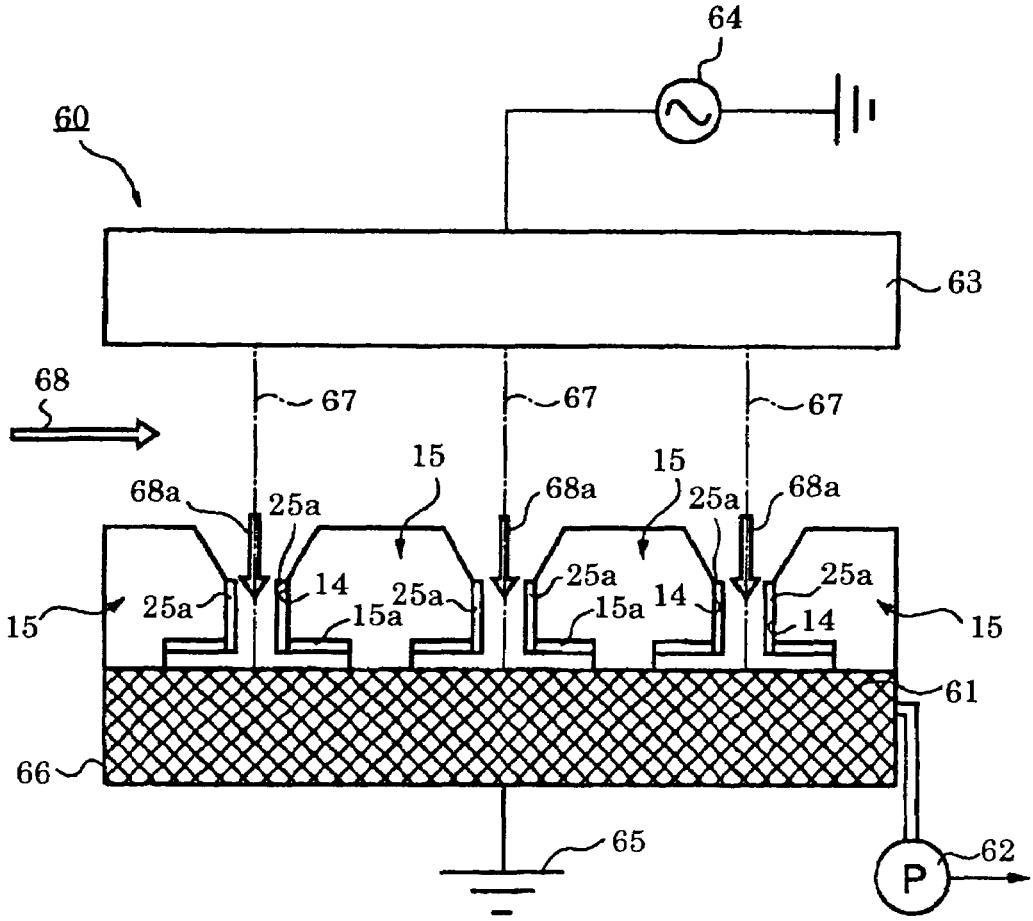
FIG. 6 is an explanatory view showing an apparatus for removing fluorocarbon resin in micropores according to the embodiment 1 of the present invention.

Hereinbelow, description will be made for the method for removing this ink-repellent film 25*a* in the ejection port 14. Note that FIG. 6 is an explanatory view showing an in-ejection-port fluorine plastic removing apparatus 60.

In the in-ejection-port fluorine plastic removing apparatus 60, the nozzle plate 15 is disposed on a vacuum evacuation plate 61 as an evacuator in a shape of a plate. An upper surface of the vacuum evacuation plate 61 is formed in a porous plate shape made of metal. Thus, it is made possible to make gas in the ejection ports 14 of the nozzle plate 15 flow through the vacuum evacuation means 61. And, a vacuum pump 62 as evacuation means is connected to a lower part of the vacuum evacuation plate 61, and the gas in the vacuum evacuation plate 61 can be evacuated by this vacuum pump 62.

Moreover, a high-frequency electrode 63 is provided above the nozzle plate 15. This high-frequency electrode 63 is electrically connected to a high-frequency power source 64. In this embodiment, the high-frequency power source 64 applies high-frequency electric power of about 13.56 MHz to the high-frequency electrode 63.

In this embodiment, the vacuum evacuation plate 61 is shaped in a box of which contour is a cuboid shape, and is electrically connected to an earth 65 by a lower surface of this box shape. As described above, the vacuum evacuation plate 61 has a function of a grounding electrode 66. Thus, gaseous discharges 67 can be generated between the high-frequency electrode 63 and the grounding electrode 66. In such a manner, the high-frequency power source 64, the high-frequency electrode 63 and the grounding electrode 66 constitute plasma generating means.

Moreover, between the high-frequency electrode 63 and the grounding electrode 66, process gas 68 is supplied from a supply source (not shown). In this embodiment, He gas is used as the process gas 68. As such process gas 68, inert gas capable of readily generating the gaseous discharges can be preferably used.

In the apparatus thus constituted, the ink-repellent films 25*a* made of the fluorocarbon resin in the ejection ports 14 can be removed as below. Specifically, the process gas 68 is introduced between the high-frequency electrode 63 and the grounding electrode 66. As shown in FIG. 6, the process gas 68 is converted into plasma by the generated gaseous discharges 67. In this embodiment, the process gas 68 is converted into plasma under the atmospheric pressure. Therefore, since an expensive vacuum apparatus is not required for converting the process gas 68 into plasma, the cost can be reduced to be inexpensive. Moreover, evacuation treatment for evacuating a region where the process gas 68 is converted into plasma is not required. Therefore, time required for removing the ink-repellent films 25*a* can be shortened.

As described above, the nozzle plate 15 is disposed on the grounding electrode 66. Accordingly, since the ink-repellent films 25*a* attached onto the ejection ports 14 of the nozzle plate 15 exist on paths of the gaseous discharges 67, the ink-repellent films 25*a* are decomposed by the process gas 68*a* converted into plasma and can be removed from the ejection ports 14. Specifically, the bond in the ink-repellent films 25*a* is cut by the activated process gas into $CF_3$, $CF_2$ and the like. Cut portions ($CF_3$, $CF_2$) are separated from the ink-repellent films 25*a*, thus making it possible to be removed from the ejection ports 14. Moreover, as described above, in the nozzle plate 15, the ink-repellent films 25 formed on the ejection surfaces 15*a* are disposed so as to face the grounding electrode 66 side. Hence, the process gas 68*a* converted into plasma does not directly contact the ink-repellent films 25.

And as described above, the grounding electrode 66 is formed integrally with the vacuum evacuation plate 61. Accordingly, the process gas 68*a* converted into plasma can be immediately flown into the ejection ports 14 to perform the decomposition process of the ink-repellent films 25*a*, and the process gas 68*a* having performed the decomposition process can be discharged from the ejection ports 14. Hence, there is no possibility that the ink-repellent films 25 formed on the peripheries of the ejection ports 14 are removed by the process gas. Accordingly, the ink-repellent films 25*a* in the ejection ports 14 can be removed without adversely affecting the peripheries of the ejection ports 14. Moreover, since the process gas 68*a* converted into plasma in the ejection ports 14 can be continuously evacuated from the vacuum evacuation plate 61 by the vacuum pump 62, the ink-repellent films 25*a* can be decomposed in an extremely short time and removed from the ejection ports 14. In this embodiment, in the case where the ink-repellent films 25, each having a film thickness of about 0.2 μm, are formed, the ink-repellent films 25*a* in the ejection ports 14 can be decomposed in about eight seconds. Thus, since an expensive vacuum apparatus is not required for converting the process gas 68 into plasma, the cost can be reduced to be inexpensive. Furthermore, the evacuation treatment for evacuating the region where the process gas 68 is converted into plasma is not required. Therefore, the time required for the process of removing the fluorocarbon resin can be shortened.

Note that, in this embodiment, the in-ejection-port fluorine plastic removing apparatus 60 and the ink-repellent treatment apparatus 30 are two different apparatuses; however, as a matter of course, these can be made into an integral apparatus.

Furthermore, the method for removing the ink-repellent films (fluorocarbon resin) in the ejection ports 14 is not limited to the above-describe method, and removing methods of embodiments 2 to 4 to be described below can be also used. Note that, in the following embodiments 2 to 4, the same members as those in the embodiment 1 will be denoted by the same name, and description thereof will be partially omitted.

Embodiment 2

Figure 7:
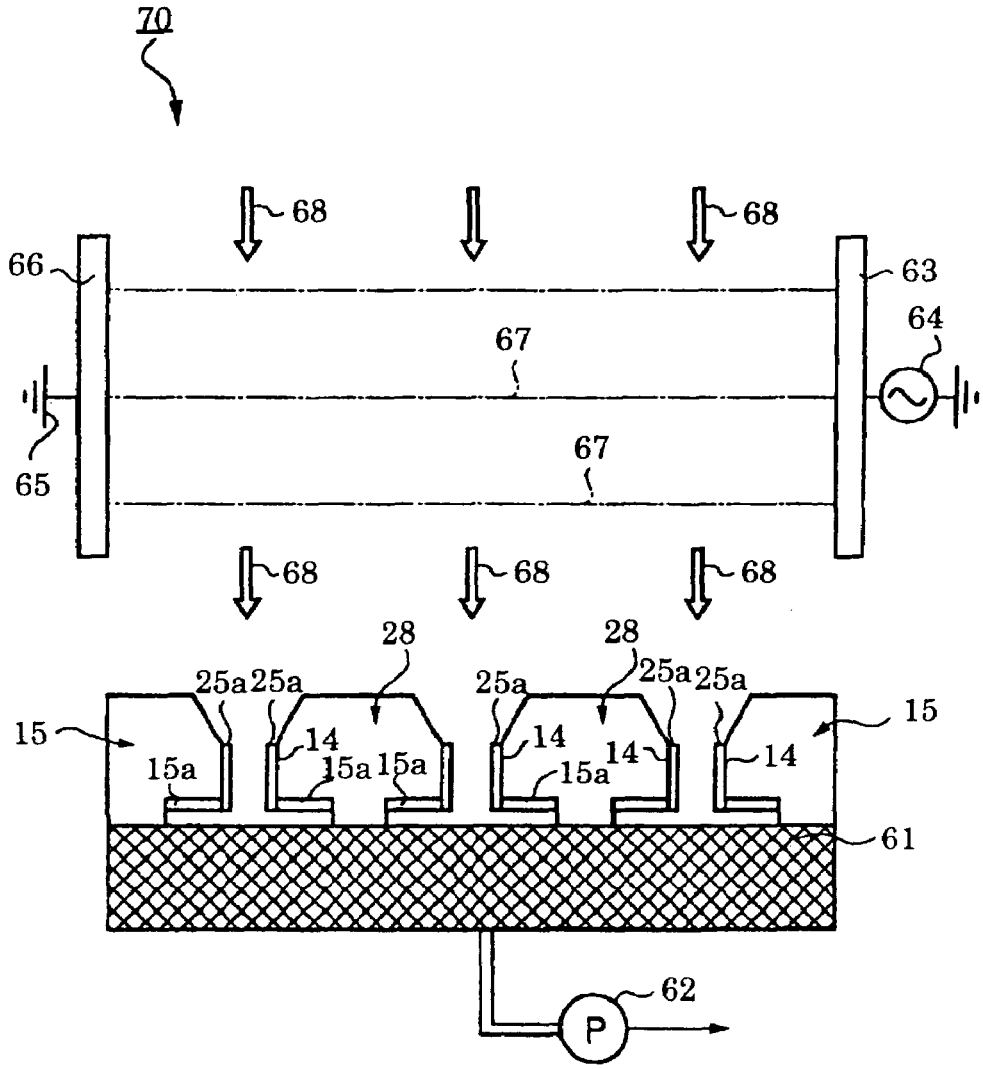
FIG. 7 is an explanatory view showing an apparatus for removing fluorocarbon resin in micropores according to an embodiment 2 of the present invention.

FIG. 7 is an explanatory view showing an in-ejection-port ink-repellent film removing apparatus 70 of the embodiment 2. The nozzle plate 15 is disposed on the vacuum evacuation plate 61. In this embodiment, the plasma generating means is provided above the nozzle plate 15. Specifically, as shown in FIG. 7, the grounding electrode 66 connected to the earth 65 is disposed above the left side of the nozzle plate 15. And, the high-frequency electrode 63 connected to the high-frequency power source 64 is disposed above the right side of the nozzle plate. The high-frequency electrode 63 and the grounding electrode 66 are disposed above the nozzle plate 15 so as to face each other. Thus, the gaseous discharges 67 can be generated between the high-frequency electrode 63 and the grounding electrode 66. And, as shown in FIG. 7, the process gas 68 is supplied from the above by supply means (not shown), and is converted into plasma by the gaseous discharges 67. The process gas 68 converted into plasma flows into the ejection ports 14 of the nozzle plate 15, and thus the ink-repellent films 25*a* can be removed. Then, the process gas 68 having decomposed the ink-repellent films 25*a* is evacuated by the vacuum pump 62 through the vacuum evacuation plate 61. In such a manner, an influence of the process gas 68 on the ink-repellent films 25 can be prevented.

Embodiment 3

Figure 8:
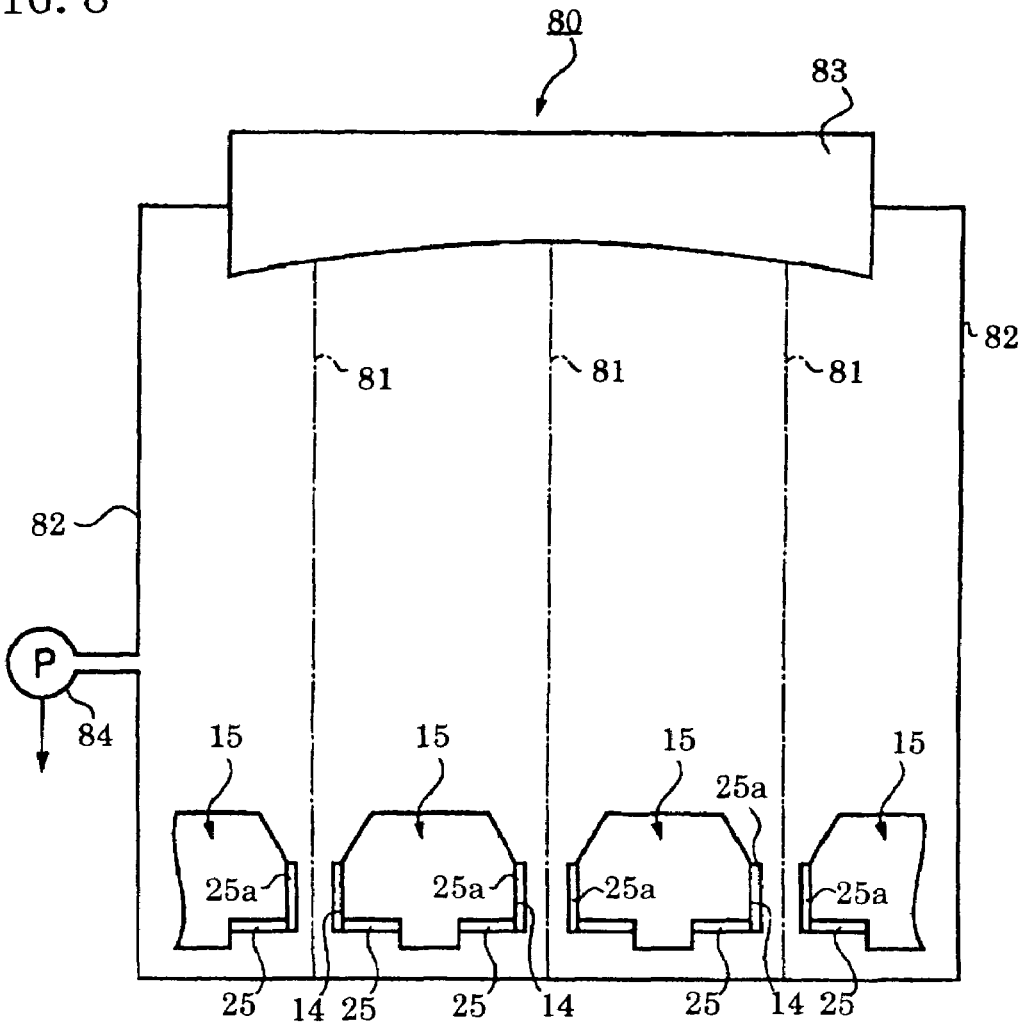
FIG. 8 is an explanatory view showing an apparatus for removing fluorocarbon resin in micropores according to an embodiment 3 of the present invention.

FIG. 8 is an explanatory view showing an in-ejection-port ink-repellent film removing apparatus 80 of the embodiment 3. In this embodiment, the case is shown, where the fluorocarbon resin 25*a* of the ejection ports 14 are removed by ultraviolet rays 81. As shown in FIG. 8, in this embodiment, a chamber 82 disposing the nozzle plate 15 therein is provided. An ultraviolet radiation lamp 83 as ultraviolet radiating means is provided in an upper portion of the chamber 82, and the ultraviolet rays 81 can be radiated downward from the ultraviolet radiation lamp 83. As shown in FIG. 8, the nozzle plate 15 is disposed in a lower portion in the chamber 82. Moreover, in this embodiment, a vacuum pump 84 as pressure reducing means is connected to the chamber 82, and the inside of the chamber 82 is maintained at a pressure nearly vacuum by the vacuum pump 84. Thus, the ultraviolet rays 81 radiated downward from the ultraviolet radiation lamp 83 in the chamber 82 can irradiate the ink-repellent films 25*a* in the ejection ports 14 without great diffusion or scattering. Since the ink-repellent films 25*a* in the ejection ports 14 are decomposed by the ultraviolet rays 81, the ink-repellent films 25*a* can be removed from the ejection ports 14 by irradiating the ultraviolet rays 81. Moreover, the ultraviolet rays 81 have properties that they become attenuated immediately after being reflected. Therefore, the situation can be prevented, where the ultraviolet rays 81 incident onto the ink-repellent films 25*a* are reflected and incident onto the ink-repellent films 25 of the ejection surfaces 15*a*. Hence, the ink-repellent films 25*a* in the ejection ports 14 can be removed without affecting the ink-repellent films 25 on the peripheries of the ejection ports 14. As such ultraviolet rays, the one having a wavelength of 380 nm or shorter can be preferably used, and the one having a wavelength of 200 nm or shorter can be more preferably used. Moreover, in the case where the ink-repellent films 25*a* in the ejection ports 14 are removed by the ultraviolet rays 81 when the ink-repellent films 25, each having a film thickness of 0.2 μm, are formed, it takes about 10 to 30 minutes for that process.

Embodiment 4

Figure 9:
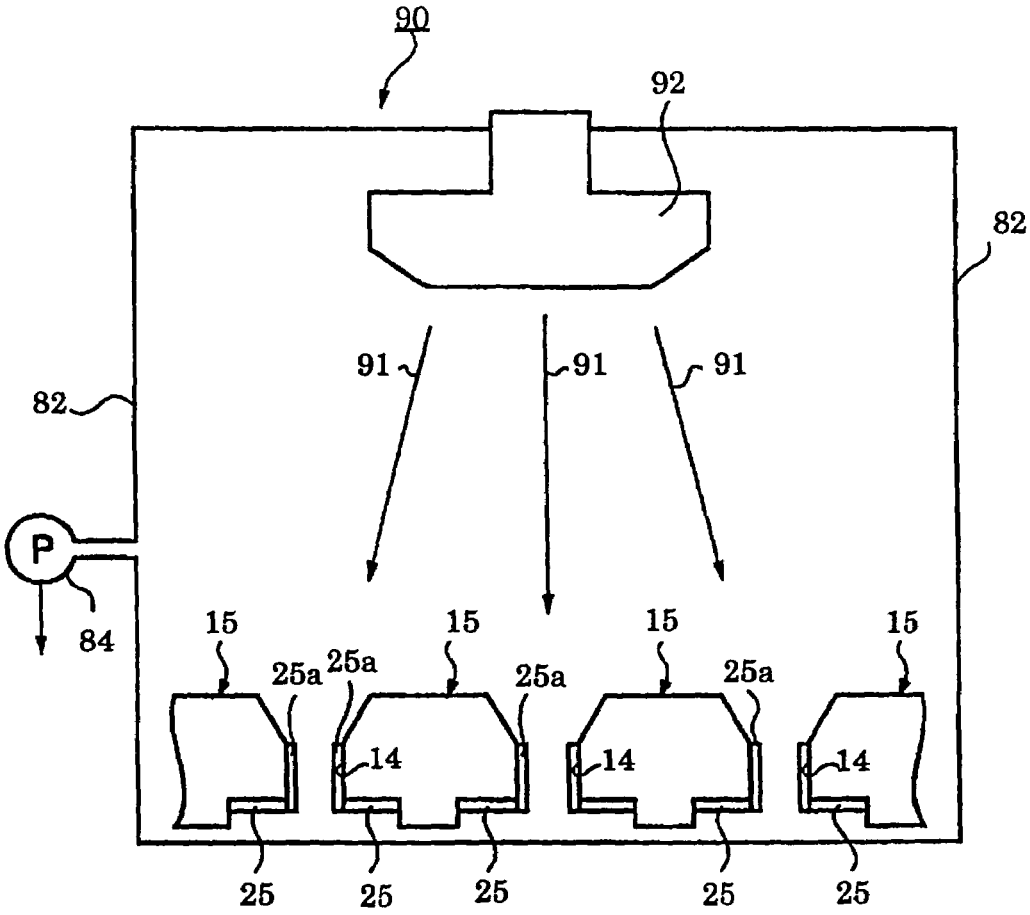
FIG. 9 is an explanatory view showing an apparatus for removing fluorocarbon resin in micropores according to an embodiment 4 of the present invention.

FIG. 9 is an explanatory view showing an in-ejection-port fluorine plastic removing apparatus 90 of the embodiment 4. In this embodiment, the case is shown, where the ink-repellent films 25*a* in the ejection ports 14 are removed by electron beams 91. As shown in FIG. 9, an electron gun 92 as electron beam radiating means is provided in an upper portion of the chamber 82, and the electron beams 91 can be radiated downward inside the chamber 82 by this electron gun 92. Moreover, the electron gun 92 is supported by the chamber 82, and the electron gun 92 can be directed downward to radiate the electron beams. And, direction of the electron beams 91 can be arbitrarily changed by a magnetic field generated by a coil (not shown). The nozzle plate 15 is disposed in a lower portion in the chamber 82. And, the vacuum pump 84 is connected to the chamber 82, and the inside of the chamber 82 can be maintained in a vacuum state by the vacuum pump 84. Thus, a mean free path of the electron beams 91 can be extended, and at the same time, an energy loss due to scattering can be avoided. The electron beams 91 are extremely excellent in rectilinear properties, and direction or quantity of the electron beams 91 can be readily adjusted by applying an electric field thereto. Therefore, the ink-repellent films 25*a* in the ejection ports 14 can be removed in a short time without affecting the peripheries of the ejection ports 14. In this embodiment, in the case where the ink-repellent films 25 are formed, each having a film thickness of about 0.2 μm, the ink-repellent films 25*a* in the ejection ports 14 can be removed in a short time of about 10 seconds.

Note that the methods for removing ink-repellent films in ejection ports and the apparatuses for removing the same, which have been described in the embodiments 1 to 4, can be suitably used for the case of removing fluorocarbon resin in micropores each having a relatively small inner diameter even though the micropores are not of the nozzle plate.

Embodiment 5

Figure 10:
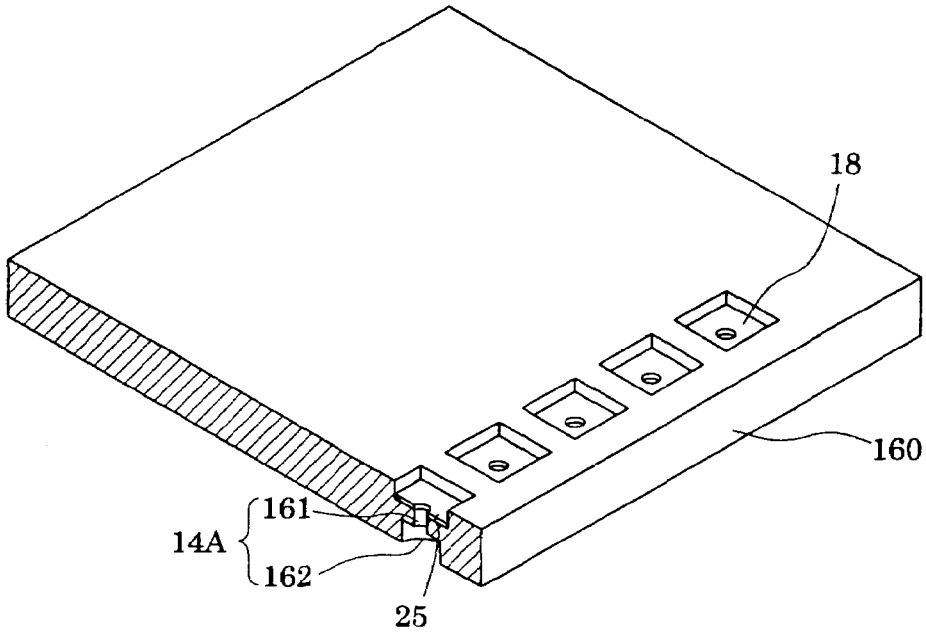
FIGS. 10(*a*) and 10(*b*) are a perspective view and a sectional view schematically showing a nozzle plate according to an embodiment 5 of the present invention.
Figure 10:
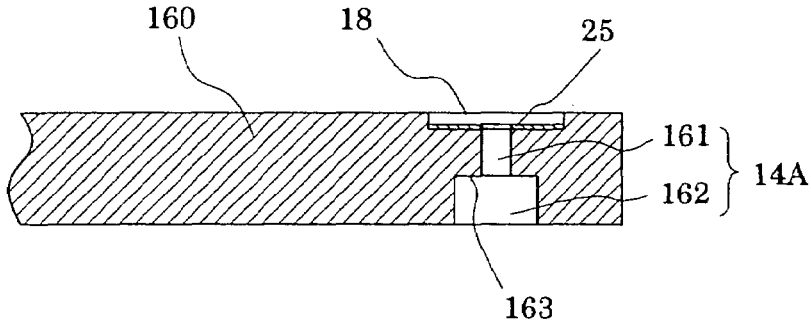

FIGS. 10(*a*) and 10(*b*) are a perspective view and a sectional view schematically showing a nozzle plate according to an embodiment 5.

This embodiment is an example where the nozzle plate is formed of a single crystal silicon substrate. As shown in FIG. 10, in a nozzle plate 160 of this embodiment, a plurality of ejection ports 14A are provided, each having a step-shaped section. Specifically, circular small-sectional nozzle portions 161 (portions on a small section side) are formed on a front side with regard to direction of ink ejection, circular large-sectional nozzle portions 162 (portions on a large section side) are formed on a rear side thereof, and boundaries between these nozzle portions constitute circular sections 163. Hence, a sectional shape obtained by cutting the ejection port 14A along its axis direction becomes smaller toward a tip side in a staircase fashion. Moreover, a tip aperture 14*a* of each ejection port 14A is open at a bottom of the crater 18 provided on the surface of the nozzle plate 160.

Moreover, on the ejection surface of such a nozzle plate 160 of this embodiment, in a region corresponding to each ejection plate 14A, there is formed an ink-repellent film 25 made of the fluorocarbon resin subjected to the plasma polymerization on this ejection surface. Note that, though not shown, on the nozzle plate 160 consisting of the single crystal silicon substrate, a silicon dioxide ($SiO_2$) layer is actually formed through oxidation of the surface thereof, and thus the ink-repellent film 25 is formed on this silicon oxide layer.

Even in the case where the ink-repellent film 25 is provided as described above on the ejection surface of the nozzle plate 160 consisting of the single crystal silicon substrate, the ink-repellent film 25 being formed by the plasma polymerization of the fluorocarbon resin, an ink-repellent film with relatively high ink repellency can be obtained.

Figure 11:
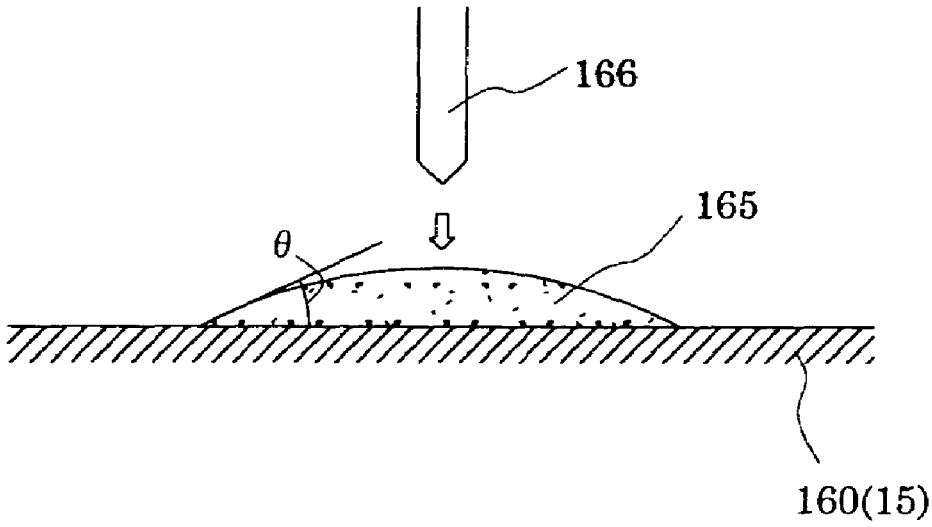
FIG. 11 is a schematic view explaining a method for measuring a contact angle.

Here, on the ink-repellent film 25 of the nozzle plate 160 of this embodiment, that is, the nozzle plate (silicon nozzle plate) which consists of the single crystal silicon substrate and has the ink-repellent film made of the fluorocarbon resin subjected to the plasma polymerization on the surface thereof, and on the ink-repellent film 25 of the nozzle plate (SUS nozzle plate) provided with the ink-repellent film by the eutectoid plating of the above-described <<Comparative example 1>>, water and ink droplets 165 were dropped by a syringe 166 as shown in FIG. 11, and a contact angle θ thereof was investigated. Results are shown in Table 1 below. Note that a measuring apparatus used in the measurement of the contact angle θ is Contact Angle System OCA (made by Kyowa Interface Science Co., Ltd.).

TABLE 1

| | | SUS nozzle plate | Silicon nozzle plate |
|---|---|---|---|
| Contact angle θ | Water | 138.7° | 130.8° |
| | Ink | 73.6° | 70.2° |

As also apparent from the results of Table 1, even in the case where the nozzle plate is formed of the single crystal silicon substrate, the ink-repellent film having ink repellency equivalent to that of the case of the eutectoid plating can be obtained by providing the ink-repellent film made of the fluorocarbon resin subjected to the plasma polymerization.

Other Embodiment

As above, description has been made for the present invention; however, the present invention is not limited to the above-described embodiments.

For example, in the above-described embodiments, the nozzle plate consisting of stainless steel or a single crystal silicon substrate is exemplified as a head member; however, the head member is not limited to the nozzle plate. For example, a head member may be employed, in which at least a part of the pressure generating chamber is formed integrally with the ejection port.

Moreover, for example, in the above-described embodiments, the ink-jet recording head of the longitudinal vibration type has been exemplified and described. However, the present invention is not limited to this. For example, the present invention can be applied to an ink-jet recording head having a piezoelectric element of a distortion/displacement type such as a piezoelectric element of a thin film type, which is manufactured through application of deposition and lithography processes and a piezoelectric element of a thick film type, which is formed by a method such as adhesion of a green sheet, or can be applied to an ink-jet recording head of an electrostatic vibration type.

Furthermore, the present invention is not limited to the one of the above-described piezoelectric vibration system. It is needles to say that the present invention can be applied, for example, to ink-jet recording heads with various structures such as the one of a bubble jet system.

As described above, the present invention can be applied to the ink-jet recording heads with various structures without departing from the purpose thereof.

Figure 12:
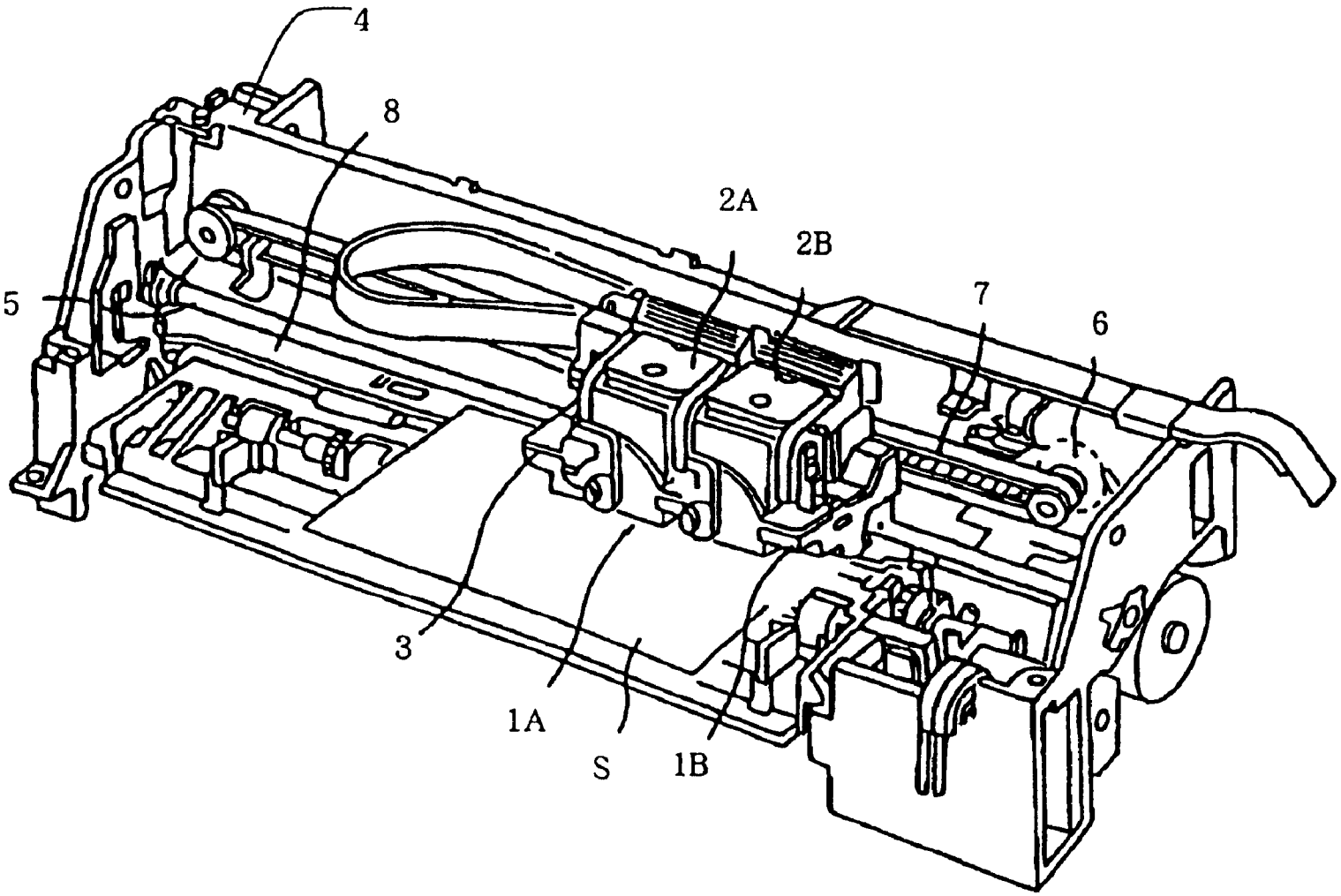
FIG. 12 is a schematic view of an ink-jet recording apparatus according to one embodiment of the present invention.
Figure 13:
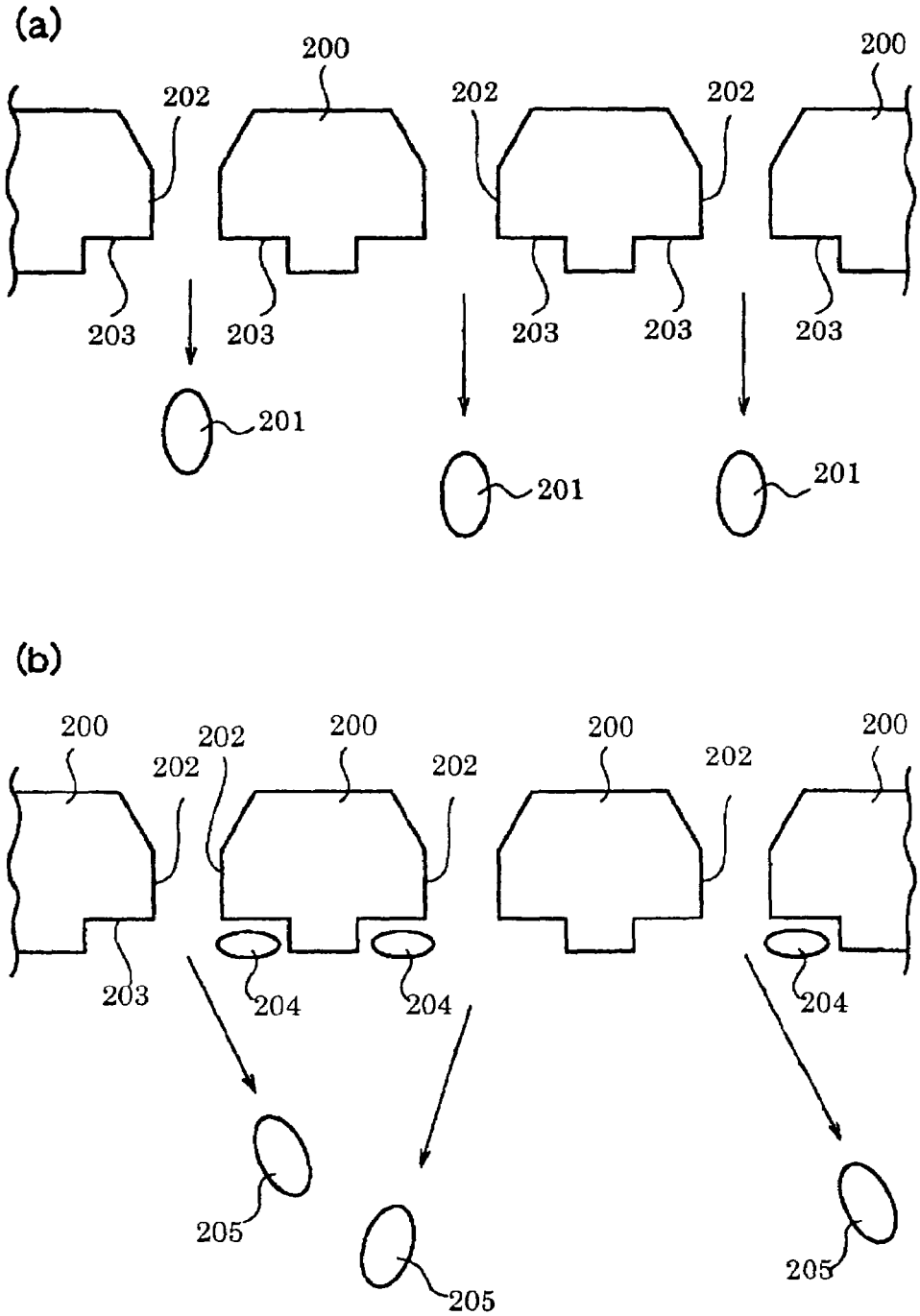
FIGS. 13(*a*) and 13(*b*) are sectional views schematically showing a conventional nozzle plate.
Figure 14:
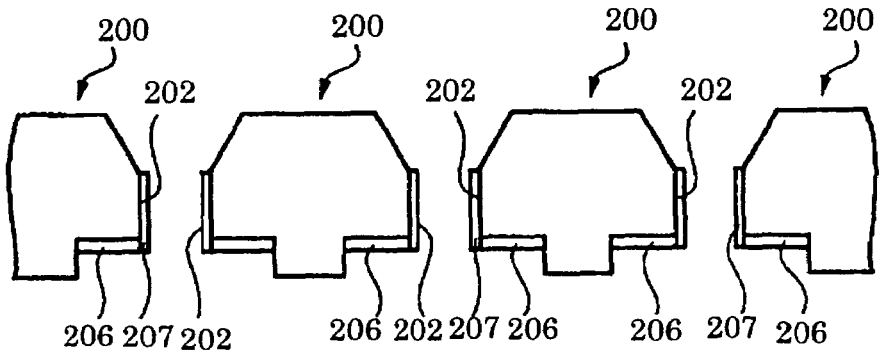
FIG. 14 is a sectional view showing a conventional nozzle plate.
Figure 15:
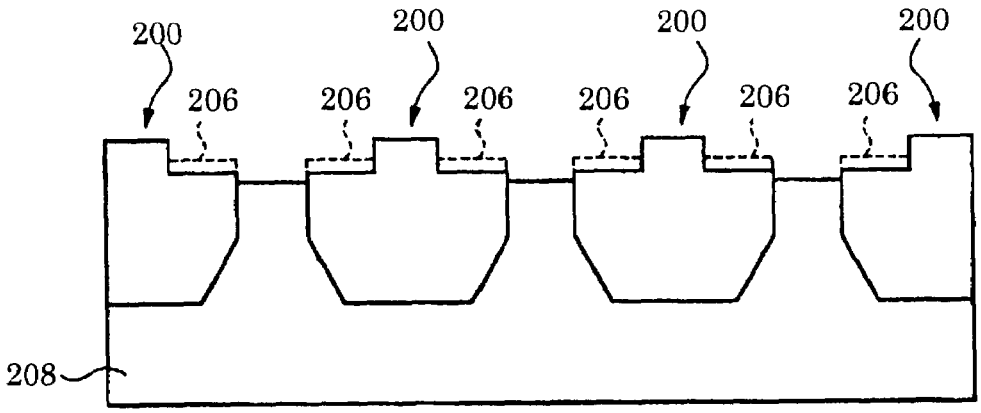
FIG. 15 is an explanatory view showing a conventional method for removing fluorocarbon resin.
Figure 16:
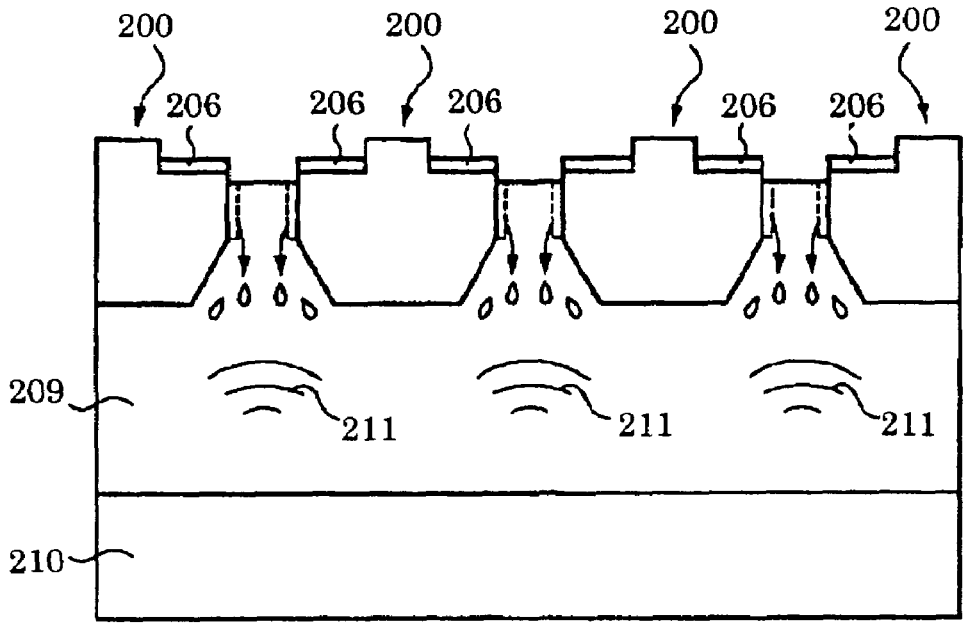
FIG. 16 is an explanatory view showing a conventional method for removing fluorocarbon resin.

Note that the ink-jet recording head of each of the above-described embodiments constitutes a part of an recording head unit including an ink passage communicating with an ink cartridge or the like, and is mounted on an ink-jet recording apparatus. FIG. 12 is a schematic view showing one example of the ink-jet recording apparatus.

As shown in FIG. 12, in recording head units 1A and 1B having the ink-jet recording heads, cartridges 2A and 2B constituting the ink supply means are detachably provided. A carriage 3 having the recording head units 1A and 1B mounted thereon is provided on a carriage shaft 5 attached to an apparatus body 4 so as to freely move in an axle direction. For example, the recording head units 1A and 1B eject a black ink composition and a color ink composition, respectively.

And, drive force of a drive motor 6 is transmitted to the carriage 3 through a plurality of gears (not shown) and a timing belt 7, and the carriage 3 having the recording head units 1A and 1B mounted thereon is thus moved along the carriage shaft 5. Meanwhile, on the apparatus body 4, a platen 8 is provided along the carriage shaft 5, and a recording sheet S that is a recording medium such as paper fed by a paper feeding roller (not shown) or the like is rolled and caught by the platen 8 to be conveyed.

As described above, in the present invention, since the fluorocarbon resin are subjected to the plasma polymerization in the chamber maintained in a vacuum state therein, there is no possibility that the water molecules or the like contained in the atmosphere are attached thereto during the plasma polymerization. Therefore, highly ink-repellent fluorocarbon resin can be formed. The ink-repellent film is formed by the plasma polymerization in such a manner, and the time can be thus shortened to a great extent in comparison with the case of the eutectoid plating, leading to substantial reduction in cost. Moreover, the durability of the ink-repellent film can be improved.

Moreover, in the present invention, the decomposition and removal of the fluorocarbon resin in the micropores such as ejection ports can be performed in a short time. Furthermore, since the fluorocarbon resin can be removed in a short time as described above, the influence imparted to the peripheries of the micropores can be lessened.

What is claimed is:

1. An in-micropore fluorine plastic removing method for removing fluorocarbon resin in micropores of a work, said micropores being provided by penetrating said work in a thickness direction, wherein ultraviolet rays are radiated from one aperture surface side of said micropores to remove the fluorocarbon resin in said micropores, wherein a fluorine plastic film is formed on one surface of said work, and wherein said ultraviolet rays are radiated into said micropores from a surface side of said work without said fluorocarbon resin formed thereon.

2. An in-micropore fluorine plastic removing method for removing fluorocarbon resin in micropores of a work, said micropores being provided by penetrating said work in a thickness direction, wherein electron beams are radiated from one aperture surface side of said micropores to remove the fluorocarbon resin in said micropores, wherein a fluorine plastic film is formed on one surface of said work, and wherein said electron beams are radiated into said micropores from a surface side of said work without said fluorocarbon resin formed thereon.

* * * * *